US010604371B2

(12) United States Patent
Kotani

(10) Patent No.: US 10,604,371 B2
(45) Date of Patent: Mar. 31, 2020

(54) SHEET STACKING DEVICE, SHEET POST-PROCESSING DEVICE AND IMAGE FORMING APPARATUS PROVIDED WITH SHEET POST-PROCESSING DEVICE

(71) Applicant: KYOCERA Document Solutions Inc., Osaka-shi (JP)

(72) Inventor: Takashi Kotani, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/253,280

(22) Filed: Jan. 22, 2019

(65) Prior Publication Data

US 2019/0225448 A1 Jul. 25, 2019

(30) Foreign Application Priority Data

Jan. 24, 2018 (JP) ..... 2018-009345

(51) Int. Cl.

| | |
|---|---|
| ***B65H 29/70*** | (2006.01) |
| ***B65H 29/12*** | (2006.01) |
| ***B65H 29/14*** | (2006.01) |
| ***B65H 29/52*** | (2006.01) |
| ***B65H 31/10*** | (2006.01) |
| ***B65H 31/36*** | (2006.01) |
| ***B65H 31/26*** | (2006.01) |

(52) U.S. Cl.

CPC ..... *B65H 29/70* (2013.01); *B65H 29/125* (2013.01); *B65H 29/14* (2013.01); *B65H 29/52* (2013.01);

(Continued)

(58) Field of Classification Search

CPC ..... B65H 29/14; B65H 29/52; B65H 29/70; B65H 29/125; B65H 31/10; B65H 31/26; B65H 31/36; B65H 2404/1114; B65H 2404/14; B65H 2404/612; B65H 2404/693; B65H 2405/11151; B65H 2801/06

(Continued)

(56) References Cited

U.S. PATENT DOCUMENTS 5,895,036 A * 4/1999 Asao ..... B42C 1/12 270/58.09
5,971,384 A * 10/1999 Asao ..... B42C 1/12 270/58.01

(Continued)

FOREIGN PATENT DOCUMENTS

| | | |
|---|---|---|
| JP | 2008-007207 | 1/2008 |
| JP | 2013-082550 | 5/2013 |

*Primary Examiner* — Leslie A Nicholson, III
(74) *Attorney, Agent, or Firm* — Gerald E. Hespos; Michael J. Porco; Matthew T. Hespos

(57) ABSTRACT

A sheet stacking device includes: a pair of sheet discharge rollers having a drive roller; a stacking tray for stacking sheets; a blade member; and a controller. The controller executes: stop processing in which the blade member is stopped at a stop position during discharging of the sheet; and rotation processing in which the blade member is rotated by one turn before a rear end of the sheet passes through the pair of sheet discharge rollers and the sheet is placed on the stacking tray. The blade is configured, in the rotation processing, to make the sheet fall on the stacking tray by beating a rear end portion of the sheet from above, and to be brought into contact with the rear end portion of the sheet which falls on the stacking tray from above while pulling the sheet toward an upstream side in the sheet discharge direction.

7 Claims, 19 Drawing Sheets

(52) U.S. Cl.
CPC ..... *B65H 31/10* (2013.01); *B65H 31/26* (2013.01); *B65H 31/36* (2013.01); *B65H 2404/1114* (2013.01); *B65H 2404/14* (2013.01); *B65H 2404/612* (2013.01); *B65H 2404/693* (2013.01); *B65H 2405/11151* (2013.01); *B65H 2801/06* (2013.01)

(58) Field of Classification Search
USPC ..... 270/58.11, 58.12, 58.17, 58.27
See application file for complete search history.

(56) References Cited

U.S. PATENT DOCUMENTS 6,142,461 A * 11/2000 Asao ..... B42C 1/12 270/58.09
7,007,948 B2 * 3/2006 Kamiya ..... B65H 31/26 270/58.12
7,198,261 B2 * 4/2007 Matsumoto ..... B65H 29/14 270/58.09
7,240,901 B2 * 7/2007 Matsumoto ..... B65H 5/34 270/58.09
7,281,708 B2 * 10/2007 Murata ..... B65H 29/34 270/58.08
7,467,789 B2 * 12/2008 Murata ..... B65H 29/34 270/58.08
7,717,422 B2 * 5/2010 Matsumoto ..... B65H 5/34 270/58.11
8,915,492 B2 * 12/2014 Sugiyama ..... B65H 31/26 270/58.12

* cited by examiner

SHEET STACKING DEVICE, SHEET POST-PROCESSING DEVICE AND IMAGE FORMING APPARATUS PROVIDED WITH SHEET POST-PROCESSING DEVICE

INCORPORATION BY REFERENCE

This application claims the priority of Japanese Patent Application No. 2018-9345 filed to the Japanese Patent Office on Jan. 24, 2018, the contents of which are incorporated herein by reference.

BACKGROUND

This disclosure relates to a sheet stacking device for stacking sheets, a sheet post-processing device which includes the sheet stacking device, and an image forming apparatus.

There has been known a sheet post-processing device which includes a post-processing mechanism for applying staple processing, hole forming processing or the like to a sheet after an image is formed on the sheet. The sheet post-processing device includes a sheet stacking device which includes: a pair of sheet discharge rollers for discharging a sheet to which post-processing is applied; and a stacking tray which receives the sheet discharged by the pair of sheet discharge rollers and stacks the sheet thereon. As the sheet stacking device of this type, there has been known a sheet stacking device which includes a rear end beating member which beats a rear end portion of the sheet which passes through the pair of sheet discharge rollers so as to make the sheet fall on the stacking tray and presses the rear end portion of the sheet which falls on the stacking tray.

In one prior art, a pressing member which functions as a rear end beating member is configured to be rotatable about a shaft disposed below a rotary shaft of a drive roller of a pair of sheet discharge rollers. The pressing member and the drive roller are rotatably driven by drive motors which form separate bodies respectively. As the pressing member rotates about an axis due to a drive force from the drive motor, the pressing member beats and presses the rear end portion of the sheet which passes through the pair of sheet discharge rollers.

In another prior art, a scrape member which functions as a rear end beating member is configured to be disposed on a rotary shaft of a driven roller of a pair of sheet discharge rollers, and to be driven to rotate by a sheet which is discharged from the pair of sheet discharge rollers. The scrape member has a plurality of flexible blade members. Due to the driven rotation of the scrape member in response to discharging of the sheet from the pair of sheet discharge rollers, the plurality of blade members beat and press a rear end portion of the sheet which passes through the pair of sheet discharge rollers.

SUMMARY

A sheet stacking device according to an aspect of this disclosure includes: a pair of sheet discharge rollers; a stacking tray; a blade member; a first drive portion; a second drive portion and a controller. The pair of sheet discharge rollers includes a drive roller which is rotatably driven, and a driven roller which is brought into pressure contact with the drive roller to be driven to rotate along with rotation of the drive roller, and discharges the sheet. The stacking tray is disposed downstream of the pair of sheet discharge rollers in a sheet discharge direction, and on which a sheet discharged by the pair of sheet discharge rollers is stacked. The blade member is disposed on a rotary shaft of the drive roller, and includes a body part rotatably supported on the rotary shaft and one blade protruding outward from the body part. The first drive portion rotatably drives the drive roller. The second drive portion rotatably drives the blade member in an identical direction with a rotational direction of the drive roller. The controller controls driving of the drive roller and the blade member by operating the first drive portion and the second drive portion.

The controller executes stop processing and rotation processing. The stop processing is processing in which the blade member is stopped at a stop position where the blade is directed toward an upstream side in the sheet discharge direction during discharging of the sheet by the pair of sheet discharge rollers. The rotation processing is processing in which the blade member is rotated by one turn from the stop position before a rear end of the sheet during discharging by the pair of sheet discharge rollers passes through the pair of sheet discharge rollers and the sheet is placed on the stacking tray. The blade is configured, in the rotation processing, to make the sheet fall on the stacking tray by beating a rear end portion of the sheet which passes through the pair of sheet discharge rollers from above, and to be brought into contact with the rear end portion of the sheet which falls on the stacking tray from above to press the rear end portion of the sheet while a pulling operation for pulling the sheet toward the upstream side in the sheet discharge direction.

A sheet post-processing device according to another aspect of this disclosure includes: a post-processing mechanism which applies predetermined post-processing to a sheet; and the above-mentioned sheet stacking device which stacks the sheet to which the post-processing is applied by the post-processing mechanism thereon.

An image forming apparatus according to still another aspect of this disclosure includes: an image forming portion which forms an image on a sheet: and the above-mentioned sheet post-processing device which applies the post-processing to the sheet on which the image is formed.

DETAILED DESCRIPTION

Hereinafter, a sheet stacking device, a sheet post-processing device and an image forming apparatus according to an embodiment of the present disclosure are described with reference to the drawings.

<Overall Configuration of Image Forming Apparatus>

Figure 1:
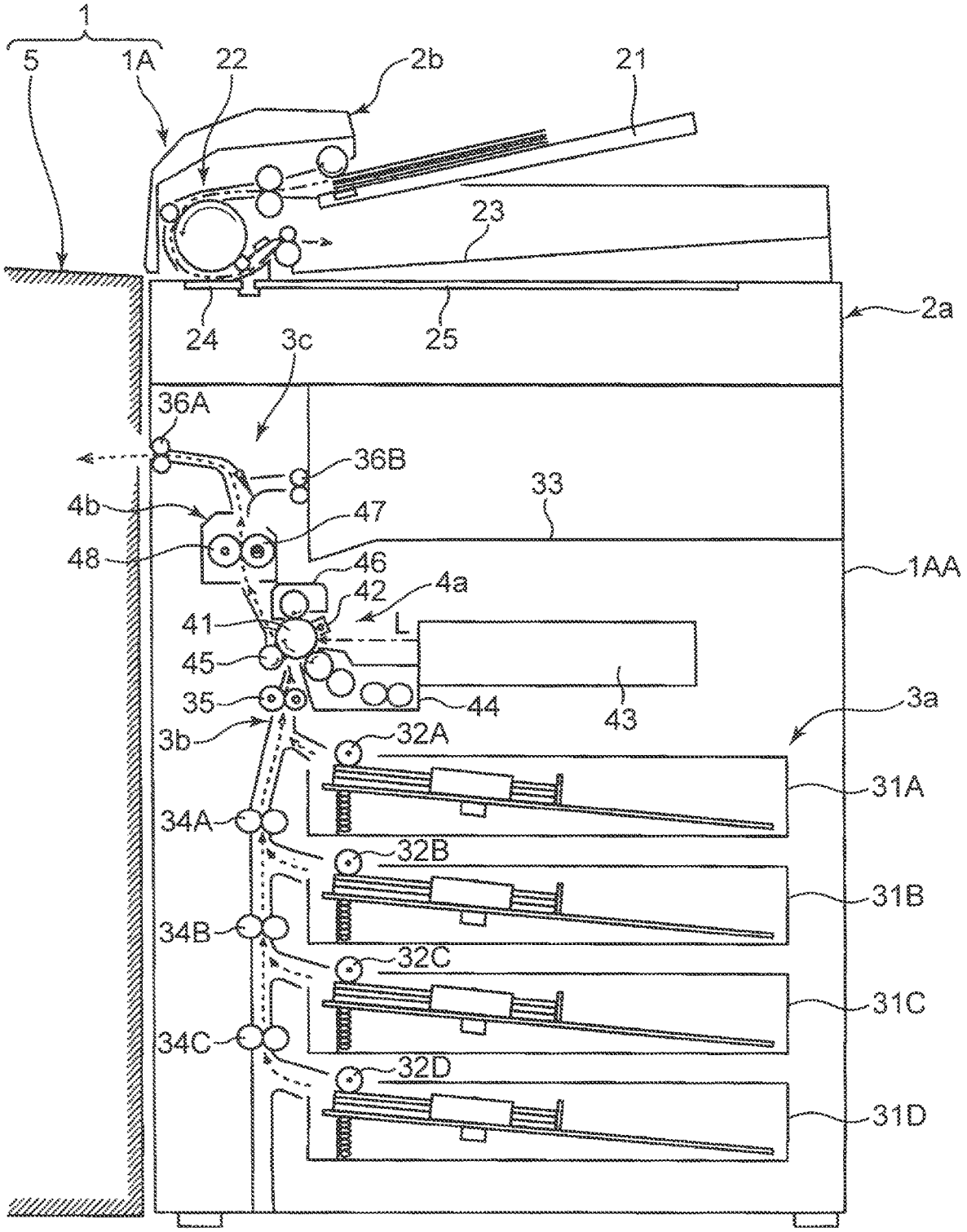
FIG. 1 is a cross-sectional view schematically showing an image forming apparatus provided with a sheet post-processing device according to one embodiment of this disclosure, and shows the internal structure of a body part.

FIG. 1 is a cross-sectional view schematically showing an image forming apparatus 1 provided with a sheet post-processing device 5. The image forming apparatus 1 includes: a body part 1A which applies image forming processing to a sheet; and the sheet post-processing device 5 which is disposed adjacently to the body part 1A and applies predetermined post-processing to a sheet or a bundle of sheets to which image forming processing is applied. In this embodiment, the body part 1A of the image forming apparatus 1 is described as a so-called in-body discharge type monochromatic copier. However, the body part 1A may be a color copier, a printer, a facsimile device or a multi-functional machine having the functions of these devices.

The body part 1A includes: a body housing 1AA; an image reading portion 2*a* disposed on an upper portion of the body housing 1AA; and an automatic document feeder (ADF) 2*b* disposed on an upper surface of the image reading portion 2*a*. In the inside of the body housing 1AA, a sheet feeding portion 3*a*, a conveyance passage 3*b*, an image forming portion 4*a*, a fixing portion 4*b*, and a sheet discharge portion 3*c* are housed.

The automatic document feeder 2*b* includes: a document tray 21 on which a document sheet is placed; a document conveyance portion 22 which conveys the document sheet through a document reading position; and a document discharge tray 23 to which the document sheet after a reading operation is discharged.

The image reading portion 2*a* has a box-shaped casing structure, and a first contact glass 24 for reading a document sheet automatically fed from the automatic document feeder 2*b*, and a second contact glass 25 for reading a document sheet placed by a hand are fitted on an upper surface of the image reading portion 2*a*. The image reading portion 2*a* optically reads an image on the document sheet.

The sheet feeding portion 3*a* in the body housing 1AA includes a plurality of cassettes 31 for storing sheets (the cassettes in four stages consisting of the cassettes 31A, 31B, 31C, and 31D from above in an example shown in FIG. 1). Each cassette 31 includes rotatably driven sheet feeding rollers 32 (four sheet feeding rollers in total consisting of the sheet feeding rollers 32A, 32B, 32C, and 32D from above in FIG. 1). The sheet feeding rollers 32 feed the sheets to the conveyance passage 3*b* one by one at the time of forming an image.

The conveyance passage 3*b* is a conveyance passage for conveying a sheet in the body housing 1AA from the sheet feeding portion 3*a* to an in-body discharge tray 33 or the sheet post-processing device 5. The conveyance passage 3*b* is provided with guide plates for guiding a sheet, a pair of conveyance rollers 34 rotatably driven at the time of conveying the sheet (three pairs of conveyance rollers 34 in total consisting of the pairs of conveyance rollers 34A, 34B, and 34C from above in FIG. 1), and a pair of resist rollers 35 which makes a sheet to be conveyed stand by just in front of the image forming portion 4*a* and feeds the sheet at transfer timing of a formed toner image.

The image forming portion 4*a* forms a toner image, and transfers the toner image to a sheet. That is, an image is formed on the sheet. The image forming portion 4*a* includes: a photosensitive drum 41; and an electric charger 42; an exposure unit 43, a developer 44; a transfer roller 45 and a cleaner 46 which are arranged around the photosensitive drum 41.

The fixing portion 4*b* fixes the toner image transferred to the sheet. The fixing portion 4*b* includes: a heating roller 47 which incorporates a heating element therein; and a pressure applying roller 48 which is brought into pressure contact with the heating roller 47. When the sheet to which the toner image is transferred passes through between a fixing nip portion formed by the heating roller 47 and the pressure applying roller 48, the toner image is fixed to the sheet. After such fixing processing, the sheet is fed to the sheet discharge portion 3*c*.

The sheet discharge portion 3*c* includes a pair of outside discharge rollers 36A for feeding a sheet on which an image is already formed in a direction toward the sheet post-processing device 5; and a pair of inner discharge rollers 36B for feeding the above-mentioned sheet in a direction toward the in-body discharge tray 33. The respective pairs of discharge rollers 36A, 36B are rotatably driven at the time of discharging the sheet so that the sheet is discharged to the outside of the body part 1A.

<Overall Configuration of Sheet Post-Processing Device>

The sheet post-processing device 5 applies predetermined post-processing to a sheet or a bundle of sheets to which image forming processing is applied in the body part 1A. Examples of the post-processing include a hole forming processing for forming binding holes in a sheet and staple processing for stapling a bundle of sheets.

Figure 2:
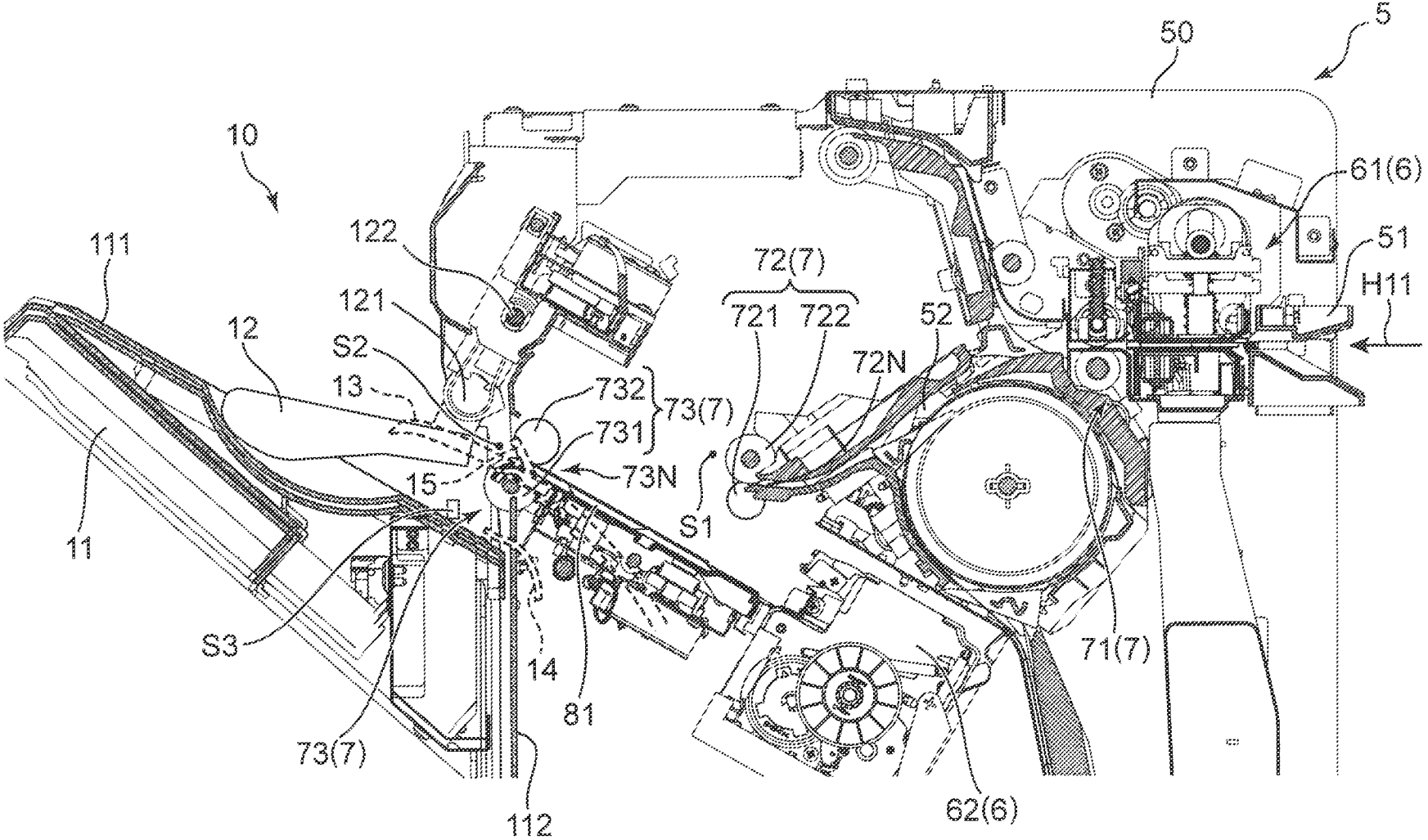
FIG. 2 is a cross-sectional view showing the internal structure of the sheet post-processing device.

FIG. 2 is a cross-sectional view showing the internal structure of the sheet post-processing device 5. The sheet post-processing device 5 includes: a post-processing housing 50 which is disposed adjacently to the body housing 1AA of the body part 1A; a post-processing mechanism 6; and a sheet conveyance mechanism 7, which are disposed in the post-processing housing 50; and a sheet stacking device 10.

The post-processing housing 50 is a box-shaped housing having an inner space in which various mechanisms which form the sheet post-processing device 5 can be housed. A sheet fed out from the pair of outside discharge rollers 36A of the body part 1A is fed to the post-processing housing 50. A sheet receiving portion 51 which receives a sheet fed out from the pair of outside discharge rollers 36A in the post-processing housing 50 is formed on a side surface of the post-processing housing 50 which opposedly faces the body housing 1AA. In the inside of the post-processing housing 50, a sheet conveyance passage 52 is formed. The sheet conveyance passage 52 forms a conveyance passage for a sheet received in the post-processing housing 50 by the sheet receiving portion 51.

In the post-processing housing 50, the post-processing mechanism 6 applies predetermined post-processing to a sheet. In this embodiment, the post-processing mechanism 6 includes: a hole forming processing portion 61; and a staple processing portion 62.

The staple processing portion 62 is a first post-processing portion disposed below the sheet conveyance passage 52. The staple processing portion 62 performs staple processing by stapling a bundle of sheets formed of a plurality of sheets.

In this embodiment, staple processing is processing for so-called end binding by stapling a corner portion or an end portion of the bundle of sheets.

The hole forming processing portion 61 is a second post-processing portion disposed at an upstream end of the sheet conveyance passage 52 in a sheet conveyance direction H11. That is, the hole forming processing portion 61 is disposed adjacently to a downstream side of the sheet receiving portion 51 in the sheet conveyance direction H11. The hole forming processing portion 61 performs hole forming processing for forming binding holes in a sheet which passes the sheet receiving portion 51 and is conveyed along the sheet conveyance passage 52. In this embodiment, the hole forming processing is processing for forming binding holes along a side edge of a sheet on one side in a sheet width direction orthogonal to the sheet conveyance direction H11.

The sheet conveyance mechanism 7 is a mechanism which is disposed in the sheet conveyance passage 52 and conveys a sheet in the sheet conveyance direction H11 along the sheet conveyance passage 52. The sheet conveyance mechanism 7 includes: a pair of conveyance rollers 71; a pair of intermediate conveyance rollers 72; and a pair of sheet discharge rollers 73. As shown in FIG. 2, the pair of conveyance rollers 71, the pair of intermediate conveyance rollers 72, and the pair of sheet discharge rollers 73 are arranged from an upstream to a downstream in the sheet conveyance direction H11 in this order.

The pair of conveyance rollers 71 is a pair of sheet conveyance rollers disposed adjacently to the hole forming processing portion 61 on a downstream side in the sheet conveyance direction H11. By rotatably driving the pair of conveyance rollers 71, a sheet to which hole forming processing is already applied by the hole forming processing portion 61 or a sheet to which hole forming processing is not applied is conveyed toward a downstream side.

The pair of intermediate conveyance rollers 72 is the pair of sheet conveyance rollers disposed between an upstream end and a downstream end in the sheet conveyance direction H11 in the sheet conveyance passage 52. The pair of intermediate conveyance rollers 72 is formed of: a first drive roller 721 which is rotated when a drive force is applied from a conveyance drive portion 70 (see FIG. 7 described later); and a first driven roller 722 which is driven to rotate along with the rotation of the first drive roller 721. A peripheral surface of the first drive roller 721 and a peripheral surface of the first driven roller 722 are brought into contact with each other with a predetermined nip pressure between the peripheral surfaces thus forming a first nip portion 72N where a sheet is nipped and conveyed.

A first sheet detection sensor S1 is disposed just on a downstream side of the pair of intermediate conveyance rollers 72. The first sheet detection sensor S1 is a sensor which optically detects a sheet. The first sheet detection sensor S1 detects that a front end of a sheet conveyed by the pair of conveyance rollers 71 advances to the pair of intermediate conveyance rollers 72. The first sheet detection sensor S1 also detects that a rear end of the sheet conveyed by the pair of intermediate conveyance rollers 72 passes the pair of intermediate conveyance rollers 72.

The pair of sheet discharge rollers 73 is a pair of sheet conveyance rollers which is disposed at a downstream end of the sheet conveyance passage 52 in the sheet conveyance direction H11. The pair of sheet discharge rollers 73 includes: a second drive roller 731 rotated when a drive force is applied to the second drive roller 731 from a discharge drive portion 90 (see FIG. 7 described later); and a second driven roller 732 driven to rotate along with the rotation of the second drive roller 731. The second drive roller 731 is rotated about a rotary shaft 7311 which extends linearly in a sheet width direction orthogonal to the sheet conveyance direction H11. A peripheral surface of the second drive roller 731 and a peripheral surface of the second driven roller 732 are brought into contact with each other with a predetermined nip pressure thus forming a second nip portion 73N where a sheet is nipped and conveyed. The second nip portion 73N is released, for example, at the time of performing staple processing by the staple processing portion 62. To enable such a release operation, the sheet post-processing device 5 includes a nip release mechanism 74 (see FIG. 7 described later). Upon receiving a drive force from a nip release drive portion 91, the nip release mechanism 74 releases the second nip portion 73N by lifting the second driven roller 732.

A second sheet detection portion S2 is disposed just on a downstream side of the pair of sheet discharge rollers 73. The second sheet detection portion S2 includes: an actuator having a contact piece with which a sheet to be discharged from the pair of sheet discharge rollers 73 is brought into contact and a detection piece; and a photo sensor having a light emitting portion and a light receiving portion which are disposed so as to sandwich the detection piece therebetween. The actuator is rotated in a clockwise direction when the sheet discharged by the pair of sheet discharge rollers 73 is brought into contact with the contact piece. At this stage of operation, the detection piece is positioned outside of an optical path between the light emitting portion and the light receiving portion of the photo sensor thus allowing passing of light irradiated from the light emitting portion to the light receiving portion. With such an operation, the second sheet detection portion S2 detects that a front end of the sheet conveyed by the pair of intermediate conveyance rollers 72 advances to the pair of sheet discharge rollers 73, and that the sheet is being discharged by the pair of sheet discharge rollers 73. On the other hand, when a rear end of the sheet passes through between the pair of sheet discharge rollers 73 and no sheet is brought into contact with the contact piece, the actuator is rotated in a counterclockwise direction. At this stage of operation, the detection piece is positioned on the optical path between the light emitting portion and the light receiving portion of the photo sensor so that light irradiated from the light emitting portion is shut off. Accordingly, the second sheet detection portion S2 detects that the rear end of the sheet discharged by the pair of sheet discharge rollers 73 passes through the pair of discharge rollers 73.

The sheet post-processing device 5 includes a processing tray 81 which receives a sheet conveyed by the pair of intermediate conveyance rollers 72 and allows stacking of the sheet thereon. The processing tray 81 is a tray disposed below the sheet conveyance passage 52. The processing tray 81 receives the sheet which is conveyed by the pair of intermediate conveyance rollers 72 in a state that the second nip portion 73N of the pair of sheet discharge rollers 73 is released by the nip release mechanism 74, and to which staple processing is applied by the staple processing portion 62. The processing tray 81 is inclined such that a downstream end side in the sheet conveyance direction H11 becomes highest and the processing tray 81 is gradually lowered toward an upstream end side in the sheet conveyance direction H11. A downstream end of the processing tray 81 is positioned in the vicinity of the pair of sheet discharge rollers 73, and an upstream end of the processing tray 81 is positioned below the pair of intermediate conveyance rollers 72. With such a configuration, the processing tray 81 is positioned below the sheet conveyance passage 52 which connects the first nip portion 72N and the second nip portion 73N.

A sheet which is once placed on the processing tray 81 and to which staple processing is applied by the staple processing portion 62 is discharged to the sheet stacking device 10 by the pair of sheet discharge rollers 73 where the second nip portion 73N is restored. The pair of sheet discharge rollers 73 forms a portion of the sheet stacking device 10, and functions as a sheet discharge portion for discharging the sheet in the sheet stacking device 10.

<Overall Configuration of Sheet Stacking Device>

Figure 3:
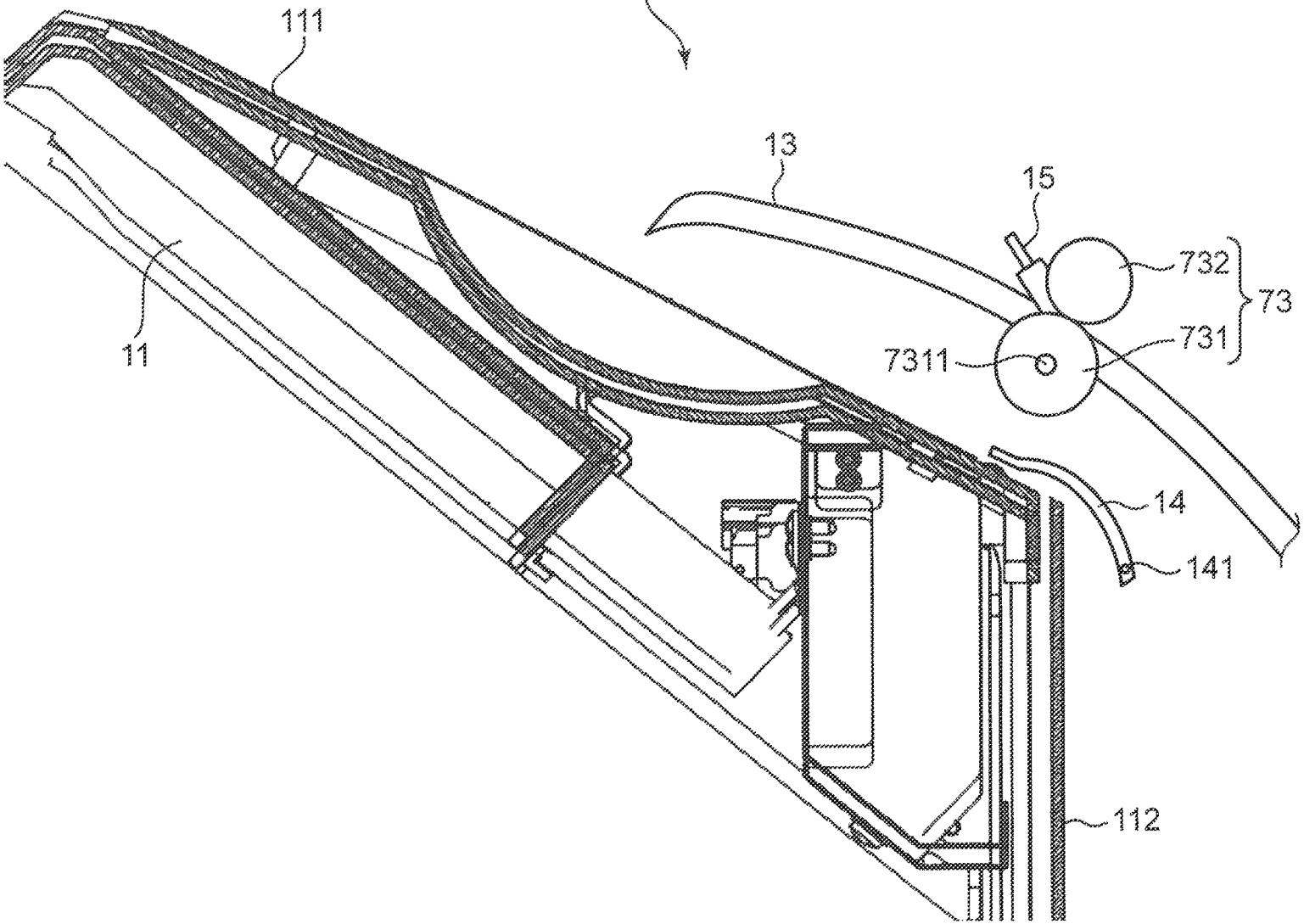
FIG. 3 is a view schematically showing the configuration of a sheet stacking device provided to the sheet post-processing device.

The sheet stacking device 10 is a device for stacking a sheet to which post-processing is applied by the post-processing mechanism 6. The sheet stacking device 10 is described with reference to FIG. 3 in addition to FIG. 2. FIG. 3 is a view schematically showing the configuration of the sheet stacking device 10. The sheet stacking device 10 includes a stacking tray 11, a pair of second cursors 12, an advancing and retracting member 13 (projecting member), a pressing member 14, and a sheet rear end beating member 15. In FIG. 3, the pair of second cursors 12 is omitted.

The stacking tray 11 is a tray which is disposed downstream of the pair of sheet discharge rollers 73 in the sheet conveyance direction H11 (hereinafter, referred to as a sheet discharge direction H11), and forms a final discharge place of a sheet in the sheet post-processing device 5. The stacking tray 11 has a sheet stacking surface 111 on which a sheet is stacked. The sheet to be stacked is a sheet to which hole forming processing is already applied by the hole forming processing portion 61 or a sheet to which staple processing is already applied by the staple processing portion 62, and such a sheet is discharged by the pair of sheet discharge rollers 73. The sheet stacking surface 111 is inclined such that a downstream end side of the sheet stacking surface 111 in the sheet discharge direction H11 becomes highest and the sheet stacking surface 111 is gradually lowered toward an upstream end side of the sheet stacking surface 111 in the sheet discharge direction H11. An upstream end of the sheet stacking surface 111 is positioned below the pair of sheet discharge rollers 73. A sheet receiving wall 112 is formed upright just on an upstream side of the stacking tray 11. The sheet receiving wall 112 receives an upstream end (rear end) of the sheet which falls along the sheet stacking surface 111 in the sheet discharge direction H11. The sheet stacked on the sheet stacking surface 111 of the stacking tray 11 is brought into a state where a rear end of the sheet is brought into contact with the sheet receiving wall 112.

The stacking tray 11 is configured such that the stacking tray 11 can be lifted or lowered in a vertical direction corresponding to a stacking amount of sheets on the sheet stacking surface 111. The stacking tray 11 is liftably driven by a tray lifting and lowering drive portion 113 (see FIG. 7 described later). In a state where the stacking tray 11 is disposed at the highest position, an upper surface detection sensor S3 is disposed at a position slightly on a downstream side of an upstream end of the stacking tray 11 and remote from the sheet stacking surface 111 by a predetermined distance on an upper side (see FIG. 2). The upper surface detection sensor S3 is a sensor which detects the sheet stacking surface 111 or an upper surface of a sheet stacked on the sheet stacking surface 111, and outputs a detection signal in response to the detection. The lifting and lowering operation of the stacking tray 11 is controlled corresponding to an output of a detection signal from the upper surface detection sensor S3. The control of the lifting and lowering operation of the stacking tray 11 is periodically performed at a predetermined time interval (for example, an interval of several seconds). With such a control, the position of the sheet which forms an uppermost layer on the sheet stacking surface 111 is maintained at a fixed height position. The detail of the lifting and lowering operation of the stacking tray 11 is described later.

The pair of second cursors 12 is the cursors which are brought into contact with side edge surfaces of sheets stacked on the sheet stacking surface 111 in a sheet width direction orthogonal to the sheet discharge direction H11 thus performing correction of skewing of the sheets and width adjustment processing for adjusting widths of the sheets. The pair of second cursors 12 is disposed in a spaced apart manner from each other in the sheet width direction, and is movable in the sheet width direction with respect to the sheet stacking surface 111.

As shown in FIG. 2, the pair of second cursors 12 is supported on a holder 121 in which a shaft 122 is inserted. The shaft 122 is supported by the post-processing housing 50 above the pair of sheet discharge rollers 73 in an extending manner along the sheet width direction. The holder 121 is supported on the shaft 122 in a movable manner along the sheet width direction. The holder 121 supports the pair of second cursors 12 so as to allow the pair of second cursors 12 rotatable about proximal end portions of the pair of second cursors 12 on an upstream side in the sheet discharge direction H11 such that distal end portions of the pair of second cursors 12 are vertically swingable. In other words, the pair of second cursors 12 is made to move in the sheet width direction in response to the movement of the holder 121 along the shaft 122, and is rotatably supported about the proximal end portions thereof such that distal end portions thereof are swingable in the vertical direction.

The advancing and retracting member 13 is a member which has a predetermined width in a sheet width direction and extends in an arcuate shape in the sheet discharge direction H11. The advancing and retracting member 13 is configured to advance and retract between an advanced position and a retracted position. The advanced position is the position where the advancing and retracting member 13 protrudes toward a downstream side of the pair of sheet discharge rollers 73 in the sheet discharge direction H11 such that at least a portion of the advancing and retracting member 13 opposedly faces an upper side of the sheet stacking surface 111. The retracted position is the position where the advancing and retracting member 13 is retracted toward an upstream side of the pair of sheet discharge rollers 73 in the sheet discharge direction H11. In a state where the advancing and retracting member 13 is disposed at the advanced position, the advancing and retracting member 13 is brought into contact with a lower surface of a sheet to be discharged by the pair of sheet discharge rollers 73, and guides the sheet in the sheet discharge direction H11. Further, the advancing and retracting member 13 allows the stacking of the sheet which passes through the pair of sheet discharge rollers 73 on the stacking tray 11 in a state where the advancing and retracting member 13 is disposed at the retracted position.

Figure 4A:
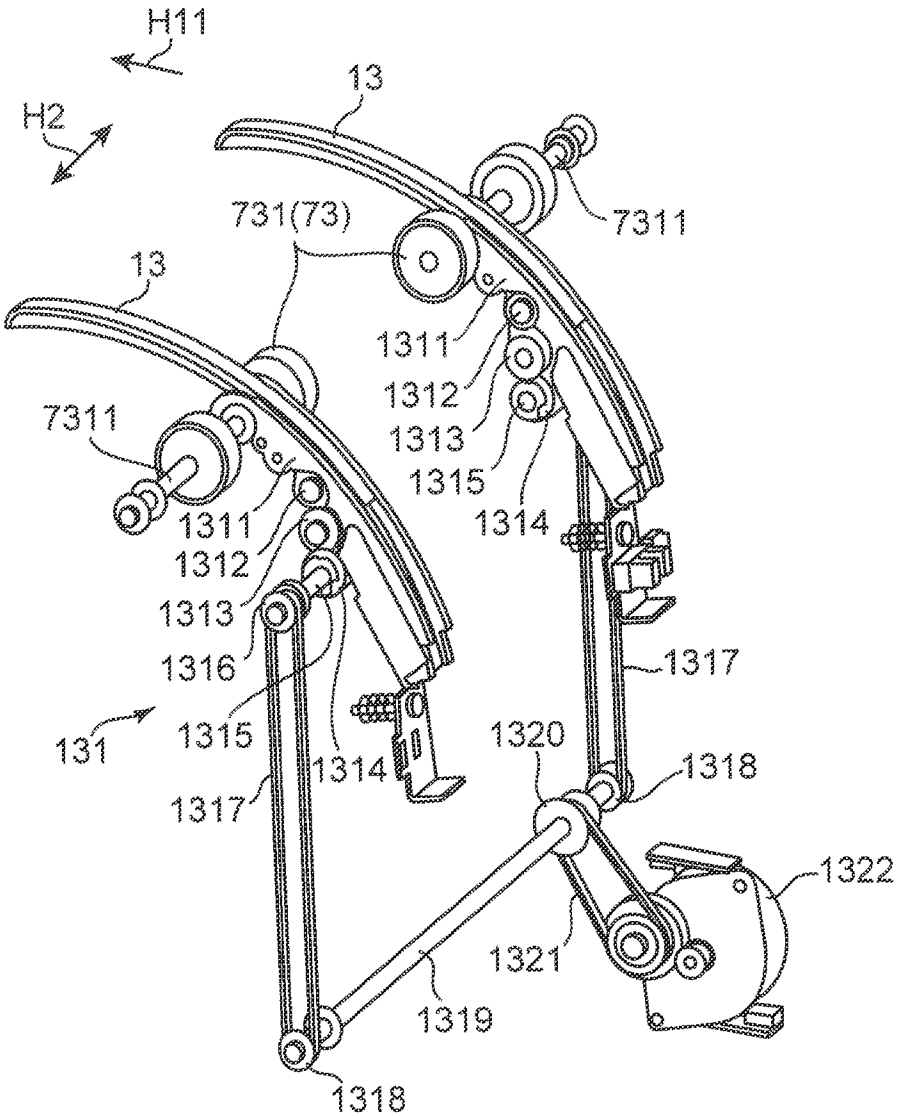
FIGS. 4A and 4B are perspective views each showing an advancing and retracting member provided to the sheet stacking device.
Figure 4B:
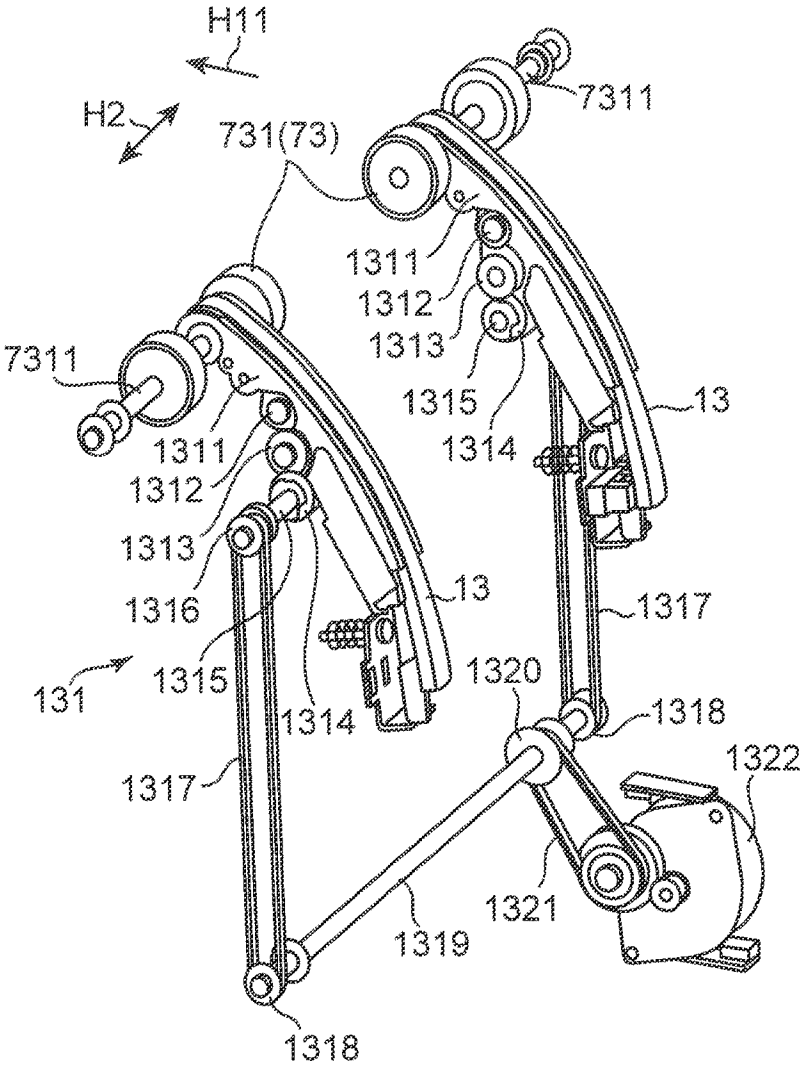

The advancing and retracting member 13 is described with reference to FIGS. 4A and 4B in addition to FIG. 3. FIGS. 4A and 4B are perspective views showing the advancing and retracting members 13. FIG. 4A shows a state where the advancing and retracting members 13 are disposed at the advanced position, and FIG. 4B shows a state where the advancing and retracting members 13 are disposed at the retracted position. A plurality of advancing and retracting members 13 are disposed in a spaced-apart manner in the sheet width direction H2. In this embodiment, two advancing and retracting members 13 are disposed. Two advancing and retracting members 13 are simultaneously driven by an advancing and retracting drive portion 131.

The advancing and retracting drive portion 131 includes: guide rails 1311 which guide an advancing and retracting operation of the advancing and retracting members 13; pinion gears 1312; first drive transmission gears 1313; drive transmission shafts 1315, a drive shaft 1319; and a drive motor 1322. The guide rails 1311, the pinion gears 1312, the first drive transmission gears 1313 and the drive transmission shafts 1315 are respectively provided in pairs corresponding to two respective advancing and retracting members 13. One drive shaft 1319 and one drive motor 1322 are provided. The advancing and retracting drive portion 131 is configured to simultaneously drive two advancing and retracting members 13 by one drive motor 1322.

Each guide rail 1311 is disposed on an upstream side of the pair of sheet discharge rollers 73 in the sheet discharge direction H11, and is formed in the same arcuate shape as each advancing and retracting member 13. A rack is formed on a lower surface side of each advancing and retracting member 13, and the advancing and retracting member 13 is movable between the advanced position and the retracted position along each guide rail 1311.

Each pinion gear 1312 is rotatable about an axis along the sheet width direction H11, and engages with the rack formed on a lower surface of each advancing and retracting member 13. Each first drive transmission gear 1313 is rotatable about an axis along the sheet width direction H11, and meshes with each pinion gear 1312. Each drive transmission shaft 1315 is a rotatable shaft extending along the sheet width direction H2. A second drive transmission gear 1314 which meshes with the first drive transmission gear 1313 is disposed on one end portion of the drive transmission shaft 1315, and a first pulley 1316 is disposed on the other end portion of the drive transmission shaft 1315.

The drive shaft 1319 is a rotatable shaft extending along the sheet width direction H2. A second pulley 1318 is disposed on each of both end portions of the drive shaft 1319 respectively, and a third pulley 1320 is disposed on an intermediate portion of the drive shaft 1319. A drive transmission belt 1317 is extended between and is wound around the second pulley 1318 and the first pulley 1316 of each drive transmission shaft 1315 respectively. A drive belt 1321 is extended between and is wound around the third pulley 1320 of the drive shaft 1319 and a motor shaft of the drive motor 1322.

In the advancing and retracting drive portion 131 having the above-mentioned configuration, when one drive motor 1322 is rotatably driven, a drive force of the drive motor 1322 is inputted to one drive shaft 1319 by way of the drive belt 1321 so as to rotate the drive shaft 1319. When the drive shaft 1319 is rotated, a rotational force of the drive shaft 1319 is transmitted to the respective drive transmission shafts 1315 by way of the drive transmission belts 1317 so as to rotate the respective drive transmission shafts 1315. When the respective drive transmission shafts 1315 are rotated, the respective second drive transmission gears 1314 are rotated integrally with such rotation, and the respective first drive transmission gears 1313 which mesh with the second drive transmission gears 1314 are also rotated. When the respective first drive transmission gears 1313 are rotated, the respective pinion gears 1312 which mesh with the first drive transmission gears 1313 are also rotated. Due to the rotation of the respective pinion gears 1312, the respective advancing and retracting members 13 each having the lower surface on which a rack with which the pinion gear 1312 engages is formed are moved in an advanceable and retractable manner between the advanced position and the retracted position along the respective guide rails 1311.

The advancing and retracting drive portion 131, during discharging a sheet by the pair of discharge rollers 73, moves the respective advancing and retracting members 13 to the advanced position so as to make the respective advancing and retracting members 13 guide the sheet being discharged. Further, the advancing and retracting drive portion 131 moves the respective advancing and retracting members 13 to the retracted position before a rear end of a sheet passes through the pair of discharge rollers 73. The detail of an advancing and retracting operation of each advancing and retracting member 13 is described later.

With reference to FIGS. 2 and 3, the pressing member 14 is a member which is disposed on an upstream side of the stacking tray 11 in the sheet discharge direction H11 and presses a rear end of a sheet stacked on the sheet stacking surface 111 from above. The pressing member 14 is disposed on a lower side of the rotary shaft 7311, and is configured to be rotatable both in a normal direction and a reverse direction about a rotary shaft 141 extending in the sheet width direction H2. The pressing member 14 is rotated about the rotary shaft 141 by a rear end pressing drive portion 142 (see FIG. 7 described later). Due to such rotation, the pressing member 14 is swingable between a rear end pressing position at which the pressing member 14 presses a rear end of a sheet stacked on the sheet stacking surface 111 from above and a rear end pressing release position at which pressing of the rear end of the sheet is released. The detail of the swingable operation of the pressing member 14 is described later.

Figure 5:
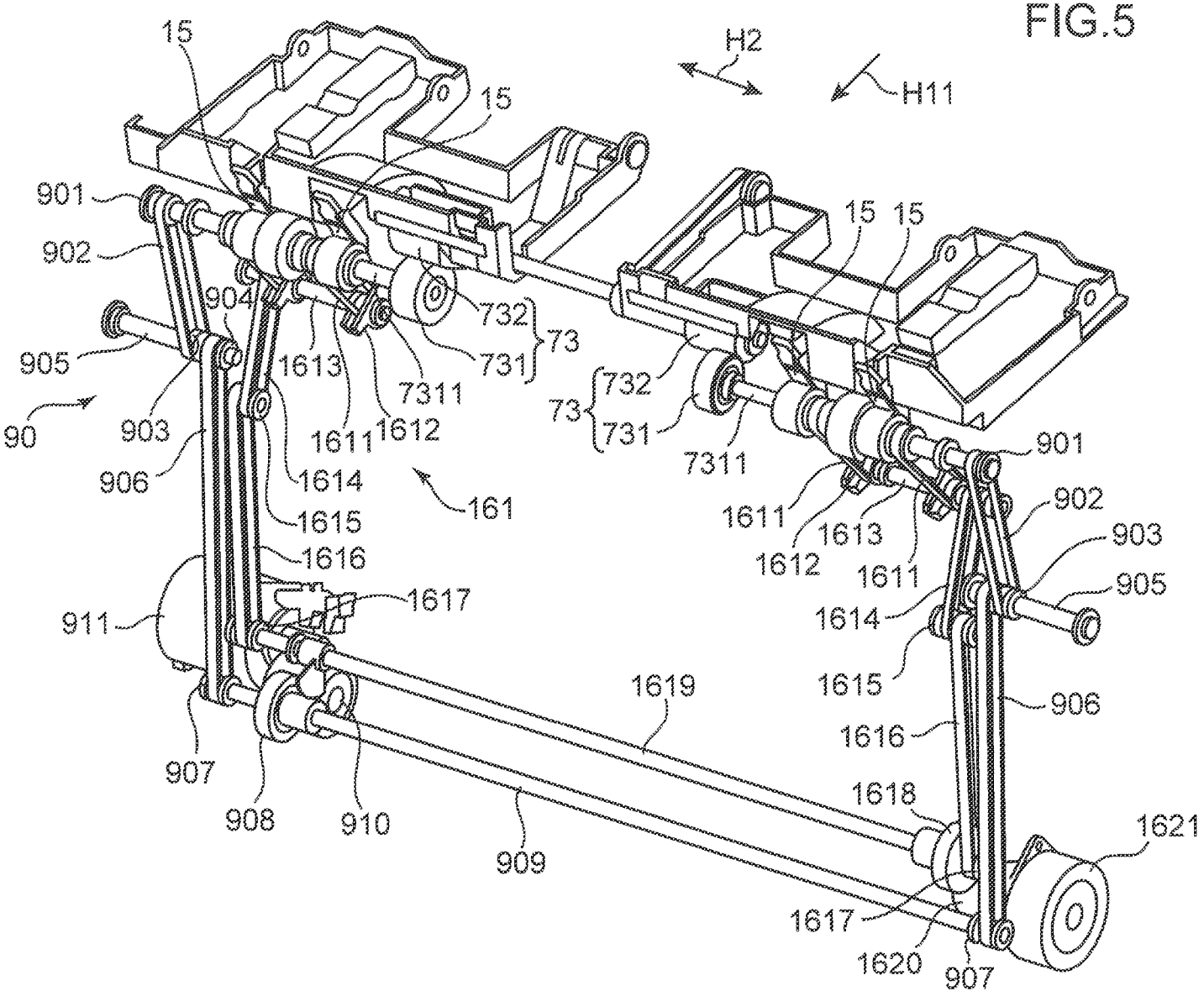
FIG. 5 is a perspective view showing a sheet rear end beating member provided to the sheet stacking device.
Figure 6:
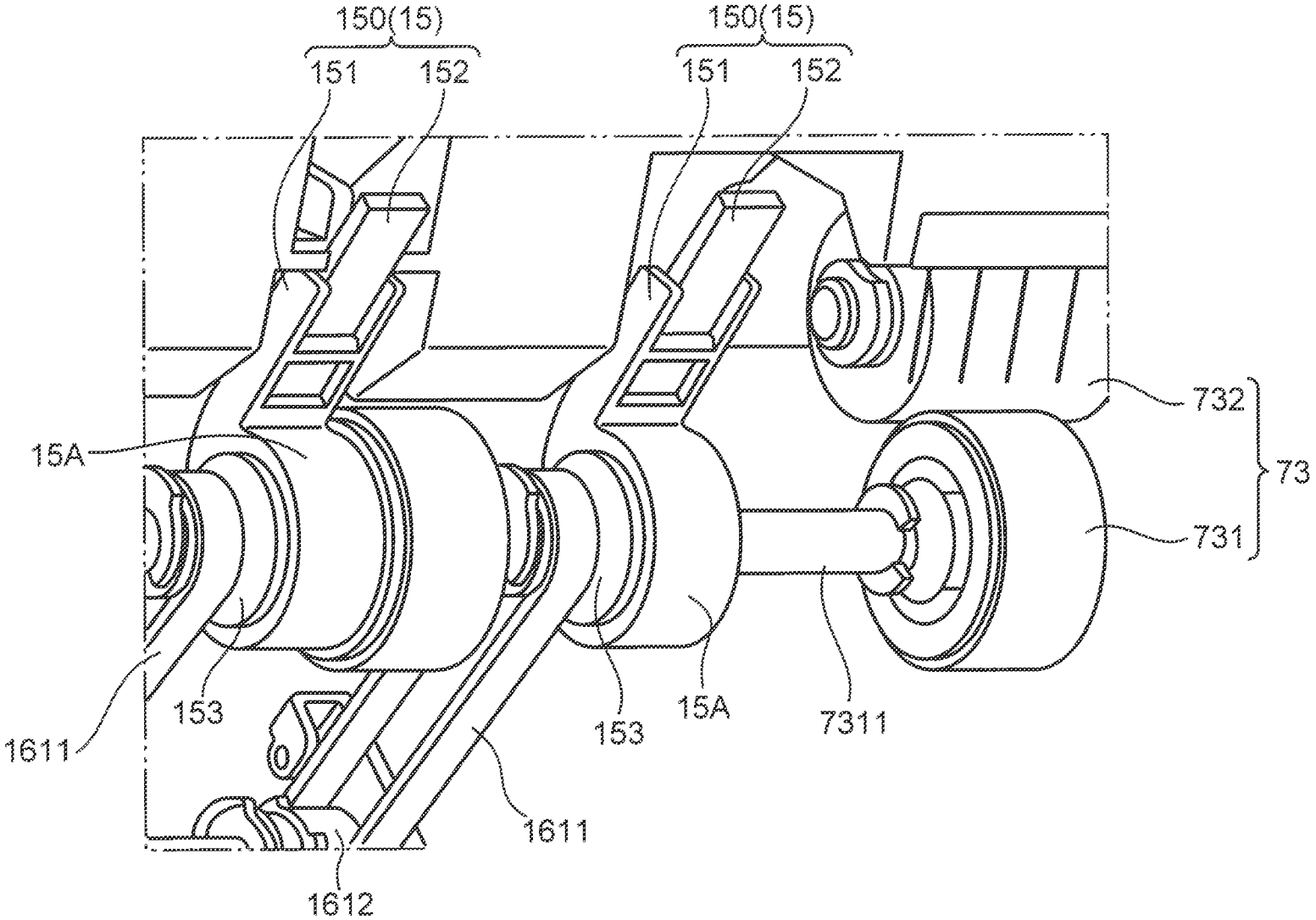
FIG. 6 is a perspective view showing the sheet rear end beating member in an enlarged manner.

The sheet rear end beating member 15 is a blade member provided for forcibly making a sheet which passes through the pair of sheet discharge rollers 73 fall on the stacking tray 11 by beating a rear end portion of the sheet in a direction toward the stacking tray 11. The sheet rear end beating member 15 is described with reference to FIGS. 5 and 6 in addition to FIG. 3. FIG. 5 is a perspective view showing the sheet rear end beating member 15, and FIG. 6 is a perspective view showing the sheet rear end beating member 15 in an enlarged manner.

A plurality of pairs of discharge rollers 73 are disposed in a spaced-apart manner in the sheet width direction H2. In this embodiment, two pairs of discharge rollers 73 are disposed. A plurality of sheet rear end beating members 15 are disposed coaxially with the respective second drive rollers 731 of the respective pairs of discharge rollers 73. Specifically, the plurality of sheet rear end beating member 15 are inserted into and mounted on the respective rotary shafts 7311 of the second drive rollers 731 in the respective pairs of discharge rollers 73. In this embodiment, the four sheet rear end beating members 15 in total are mounted in an inserted manner such that two sheet rear end beating members 15 are inserted into and mounted on the rotary shaft 7311 of the second drive roller 731 in the respective pairs of discharge rollers 73.

Four sheet rear end beating members 15 are simultaneously rotatably driven independently from the second drive roller 731. That is, four sheet rear end beating members 15 are simultaneously driven by a rear end beating drive portion 161 which is formed as a separate body from the discharge drive portion 90 which rotatably drives the second drive roller 731, and are rotated about respective rotary shafts 7311. As four sheet rear end beating members 15 are rotated about the respective rotary shafts 7311, four sheet rear end beating members 15 beat a rear end portion of the sheet which passes through the respective pairs of second discharge rollers 73 in a direction toward the stacking tray 11.

The above-mentioned pressing member 14 is disposed on a lower side of the sheet rear end beating members 15. Further, the advancing and retracting member 13, the pressing member 14, and the sheet rear end beating member 15 are respectively disposed in a spaced-apart manner from each other in the sheet width direction H2.

The second drive rollers 731 of two pairs of discharge rollers 73 are simultaneously driven by the discharge drive portions 90. As shown in FIG. 5, the discharge drive portion 90 includes a drive transmission shaft 905, a drive shaft 909, a drive gear 910, and a drive motor 911 (first drive portion). Two drive transmission shafts 905 are provided corresponding to two respective second drive rollers 731. One drive shaft 909, one drive gear 910, and one drive motor 911 are provided. The discharge drive portion 90 is configured to simultaneously drive two second drive rollers 731 by one drive motor 911.

A first pulley 901 is disposed on a rotary shaft 7311 of each second drive roller 731. Each drive transmission shaft 905 is a rotatable shaft extending along the sheet width direction H2, and a second pulley 903 and a third pulley 904 are disposed on the drive transmission shaft 905. A first drive transmission belt 902 is extended between and wound around the first pulley 901 disposed on the rotary shaft 7311 of each second drive roller 731 and the second pulley 903 of each drive transmission shaft 905.

The drive shaft 909 is a rotatable shaft extending in the sheet width direction H2. A fourth pulley 907 is disposed on each of both end portions of the drive shaft 909, and a drive transmission gear 908 is disposed on an intermediate portion of the drive shaft 909. A second drive transmission belt 906 is extended between and wound around the fourth pulley 907 and the third pulley 904. A drive gear 910 is a gear rotated by the drive motor 911 about an axis along the sheet width direction H11, and meshes with the drive transmission gear 908 disposed on the drive shaft 909.

In the discharge drive portion 90 having the above-mentioned configuration, when one drive motor 911 is rotatably driven, a drive force of the drive motor 911 is inputted to one drive shaft 909 by way of the drive gear 910 and the drive transmission gear 908 so that the drive shaft 909 is rotated. When the drive shaft 909 is rotated, a rotational force of the drive shaft 909 is transmitted to the respective drive transmission shafts 905 by way of the second drive transmission belts 906 so that the respective drive transmission shafts 905 are rotated. When the respective drive transmission shafts 905 are rotated, a rotational force of the drive transmission shafts 905 is transmitted to the respective rotary shafts 7311 by way of the first drive transmission belts 902 so as to rotate the respective rotary shafts 7311, and the respective second drive rollers 731 are integrally rotated with the rotary shafts 7311.

The rear end beating drive portion 161 which is provided as a separate body from the discharge drive portion 90 and simultaneously drives four sheet rear end beating members 15 includes: drive transmission shafts 1613, a drive shaft 1619, a drive gear 1620 and a drive motor 1621 (second drive portion). Two drive transmission shafts 1613 are provided corresponding to two sheet rear end beating members 15 which are provided for beating one end portion of a sheet which passes through between the pair of discharge rollers 73 in the sheet width direction H2 and two sheet rear end beating members 15 which are provided for beating the other end portion of the sheet in the sheet width direction H2. One drive shaft 1619, one drive gear 1620 and one drive motor 1621 are respectively provided. The rear end beating drive portion 161 is configured to simultaneously drive four sheet rear end beating members 15 by one drive motor 1621.

Four respective sheet rear end beating member 15 have, as shown in FIG. 6, a drive transmission receiving portion 153. Each drive transmission shaft 1613 is a rotatable shaft extending along the sheet width direction H2, and a pair of first pulleys 1612 are disposed on the drive transmission shaft 1613. First drive transmission belts 1611 are respectively extended between and wound around each pair of first pulleys 1612 and the drive transmission receiving portion 153 of each sheet rear end beating member 15.

The drive shaft 1619 is a rotatable shaft extending along the sheet width direction H2. The second pulley 1617 is disposed on each of both end portions of the drive shaft 1619, and the drive transmission gear 1618 is disposed on an intermediate portion of the drive shaft 1619. A second drive transmission belt 1614 and a third drive transmission belt 1616 are extended between and wound around each second pulley 1617 and each drive transmission shaft 1613 by way of the third pulley 1615. The drive gear 1620 is a gear which is rotated by the drive motor 1621 about an axis along the sheet width direction H11, and meshes with the drive transmission gear 1618 disposed on the drive shaft 1619.

In the rear end beating drive portion 161 having the above-mentioned configuration, when one drive motor 1621 is rotatably driven, a drive force of the drive motor 1621 is inputted to one drive shaft 1619 by way of the drive gear 1620 and the drive transmission gear 1618 so that the drive shaft 1619 is rotated. When the drive shaft 1619 is rotated, a rotational force of the drive shaft 1619 is transmitted to the respective drive transmission shafts 1613 by way of the second drive transmission belts 1614 and the third drive transmission belts 1616 so that the respective drive transmission shafts 1613 are rotated. When the respective drive transmission shafts 1613 are rotated, a rotational force of the drive transmission shafts 1613 is transmitted to the respective sheet rear end beating members 15 by way of the first drive transmission belts 1611. Accordingly, the respective sheet rear end beating members 15 are rotated about the rotary shafts 7311 of the second drive rollers 731, and beat a rear end portion of a sheet which passes through the pair of sheet discharge rollers 73 in a direction toward the stacking tray 11. The direction of the rotation of the respective sheet rear end beating members 15 about the rotary shafts 7311 is equal to the rotational direction of the second drive rollers 731 of the pair of sheet discharge rollers 73. The detail of the beating operation of the respective sheet rear end beating members 15 is described later.

As shown in FIG. 6, the sheet rear end beating member 15 includes a circular cylindrical body part 15A and a blade 150 which protrudes outward from the body part 15A. The drive transmission receiving portion 153 around which the first drive transmission belt 1611 is wound is mounted on the circular cylindrical body part 15A. The circular cylindrical body part 15A is inserted into the rotary shaft 7311 and is rotatably supported on the rotary shaft 7311. In the sheet rear end beating member 15, only one blade 150 protrudes from the body part 15A. This one blade 150 forms a portion which beats a rear end portion of a sheet which passes through the pair of sheet discharge rollers 73 in the direction toward the stacking tray 11. The blade 150 includes: a mounting portion 151 which protrudes outward from the body part 15A; and a blade body part 152. The mounting portion 151 is a portion continuous with the body part 15A in the blade 150, is integrally formed with the body part 15A and has rigidity. The blade body part 152 is mounted on and along the mounting portion 151 such that the blade body part 152 extends outward from the mounting portion 151. The blade body part 152 has elasticity.

The sheet rear end beating member 15 is configured such that, when the sheet rear end beating member 15 is rotated about the rotary shaft 7311, the respective ends of the mounting portion 151 and the blade body part 152 pass above and near an upstream end portion of the sheet stacking surface 111 of the stacking tray 11. To describe more specifically, a length of the mounting portion 151 is set to a length that a distal end of the mounting portion 151 is brought into contact with rear ends of a bundle of sheets after staple processing which falls on the stacking tray 11 by a beating operation of the sheet rear end beating member 15. With such a configuration, it is possible to make the bundle of sheets after staple processing fall on the stacking tray 11 by the mounting portion 151 having rigidity, and it is also possible to pull the bundle of sheets fall on the stacking tray 11 toward a sheet receiving wall 112 on an upstream side. Further, in the case where a curl is generated on a rear end of the bundle of sheets, the curl can be pressed by the mounting portion 151. That is, the mounting portion 151 having rigidity has, in addition to a beating function of making bundle of sheets fall on the stacking tray 11 by beating a rear end portion of the bundle of sheets from above, a function of pulling the bundle of sheets which fall on the stacking tray 11 toward an upstream side, and a function of pressing a curl of a rear end of the bundle of sheets.

On the other hand, a length of the blade body part 152 is set to a length that a distal end of the blade body part 152 is brought into contact with rear ends of sheets to which staple processing is not applied and which fall on the stacking tray 11 by a beating operation of the sheet rear end beating members 15. With such a configuration, it is possible to make the sheets fall on the stacking tray 11 by the blade body part 152 having elasticity, and it is also possible to pull the sheets which fall on the stacking tray 11 toward the sheet receiving wall 112 on an upstream side. Further, when a curl is generated on the rear end of the sheet, the curl can be pressed by the blade body part 152. That is, the blade body part 152 having elasticity has, in addition to a beating function of making sheets fall on the stacking tray 11 by beating a rear end portion of sheets from above, a function of pulling sheets which fall on the stacking tray 11 toward an upstream side, and a function of pressing a curl of a rear end of the sheet. The beating function, the pulling function and the curl pressing function of the blade body part 152 are effectively applied to a bundle of sheets after staple processing.

<Control System of Sheet Post-Processing Device>

Figure 7:
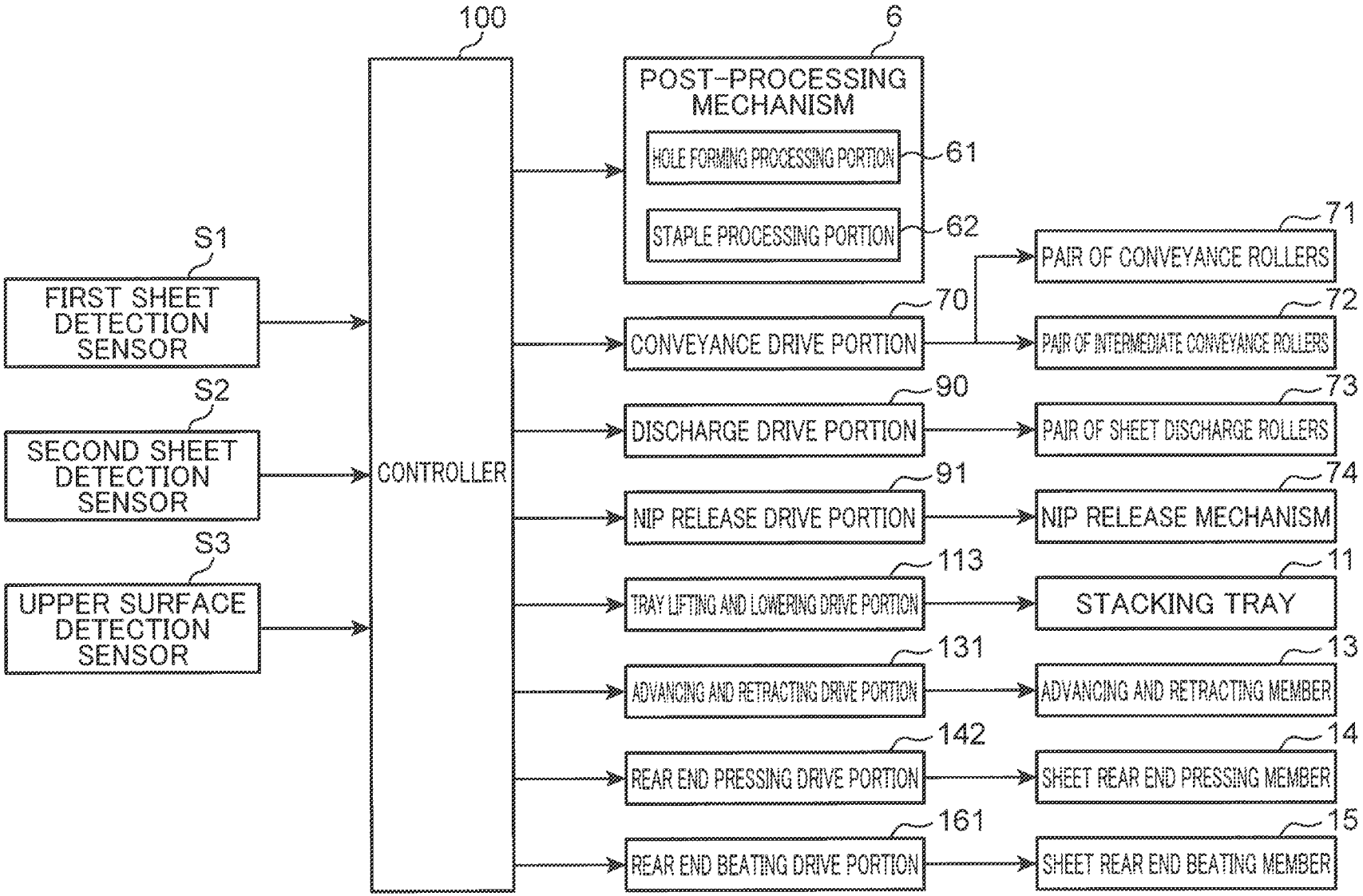
FIG. 7 is a block diagram showing a control system of the sheet post-processing device.

Next, a control system of the sheet post-processing device 5 is described with reference to a block diagram in FIG. 7. The sheet post-processing device 5 includes a controller 100. The controller 100 includes: a central processing unit (CPU) which controls operations of respective parts of the sheet post-processing device 5 including the sheet stacking device 10; a read only memory (ROM) which stores a control program; a random access memory (RAM) used as an operation area of the CPU, and the like. The controller 100 controls operations of the respective parts of the sheet post-processing device 5 including the sheet stacking device 10 by executing a control program stored in the ROM by the CPU.

The controller 100 controls: a hole forming processing operation performed by a hole forming processing portion 61 of the post-processing mechanism 6; and a staple processing operation performed by a staple processing portion 62 of the post-processing mechanism 6. The controller 100 controls the rotation and stopping of the rotation of the pair of conveyance rollers 71 and the pair of intermediate conveyance rollers 72 by controlling driving of the conveyance drive portion 70. The controller 100 controls the rotation and stopping of the rotation of the pair of sheet discharge rollers 73 by controlling driving of the discharge drive portion 90 (drive motor 911).

The controller 100 controls a release operation and a restoring operation of the second nip portions 73N of the pair of second discharge rollers 73 performed by the nip release mechanism 74 by controlling driving of the nip release drive portion 91. For example, assume the case where staple processing is applied to a bundle of sheets formed of a predetermined number of sheets by the staple processing portion 62. In this case, the controller 100 performs a control such that, after first of sheet is pulled in the processing tray 81, the nip release mechanism 74 is operated by the nip release drive portion 91 thus releasing the second nip portion 73N. Then, the controller 100 performs a control such that the second and succeeding sheets are pulled in the processing tray 81, and staple processing is applied to the bundle of sheets and, thereafter, the second nip portion 73N is restored at the time of discharging the bundle of sheets to the stacking tray 11.

<Control of Sheet Stacking Operation by Sheet Stacking Device>

The controller 100 also controls a sheet stacking operation of the sheet stacking device 10 by controlling driving of the tray lifting and lowering drive portion 113, the advancing and retracting drive portion 131, the rear end pressing drive portion 142, and the rear end beating drive portion 161. The controller 100 controls a lifting and lowering operation of the stacking tray 11 by controlling driving of the tray lifting and lowering drive portion 113. The controller 100 controls an advancing and retracting operation relating to movement between an advanced position and a retracted position of the advancing and retracting member 13 along guide rails 1311 by controlling driving of the advancing and retracting drive portion 131. The controller 100 controls a swing operation of the pressing member 14 between a rear end pressing position and a rear end pressing release position due to the rotation of the pressing member 14 about a rotary shaft 141 by controlling driving of the rear end pressing drive portion 142.

Further, the controller 100 controls a beating operation and a pressing operation by the blades 150 in response to the rotation of the sheet rear end beating members 15 about the rotary shafts 7311 by controlling driving of the rear end beating drive portion 161 (drive motor 1621). As described previously, the beating operation is an operation of beating a rear end portion of a sheet which passes through the pair of sheet discharge rollers 73 in a direction toward the stacking tray 11. The pressing operation is an operation which is performed succeeding to the beating operation, and presses the rear end portion of the sheet which falls on the stacking tray 11 by being brought into contact with the rear end portion of the sheet from above while pulling the rear end portion of the sheet toward an upstream side.

Figure 8A:
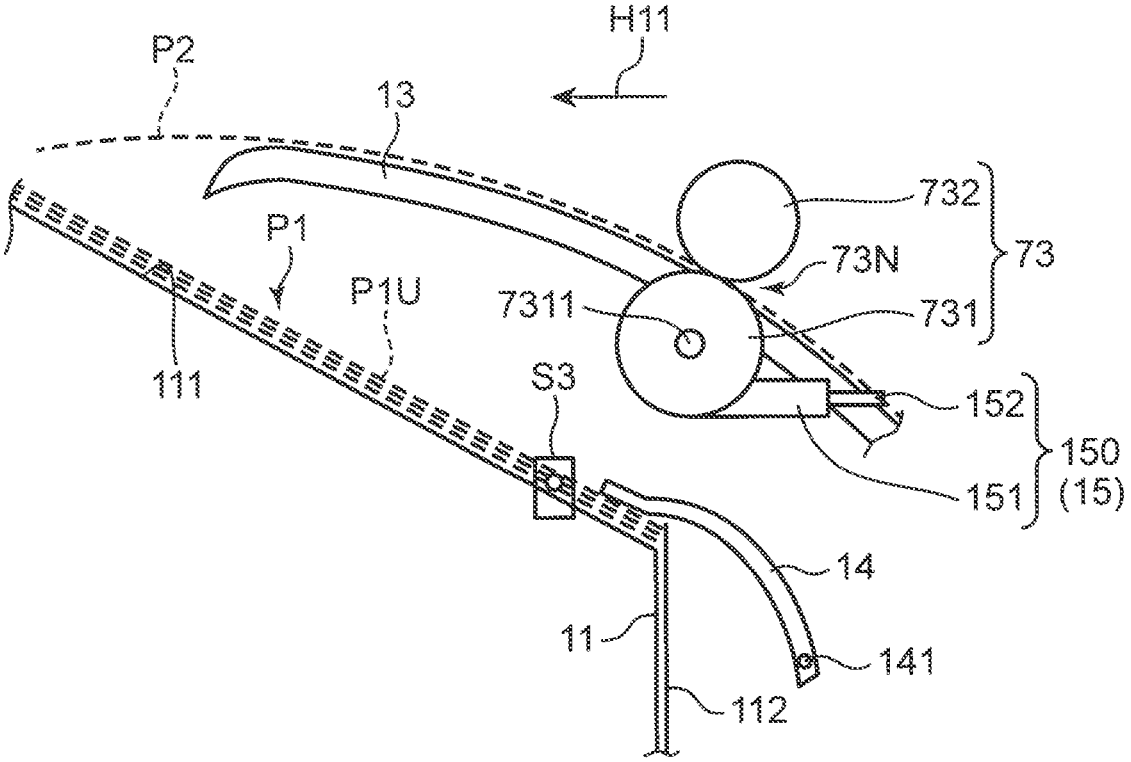
FIGS. 8A, 8B and 8C are views for describing a lifting and lowering operation of a stacking tray of the sheet stacking device.
Figure 8B:
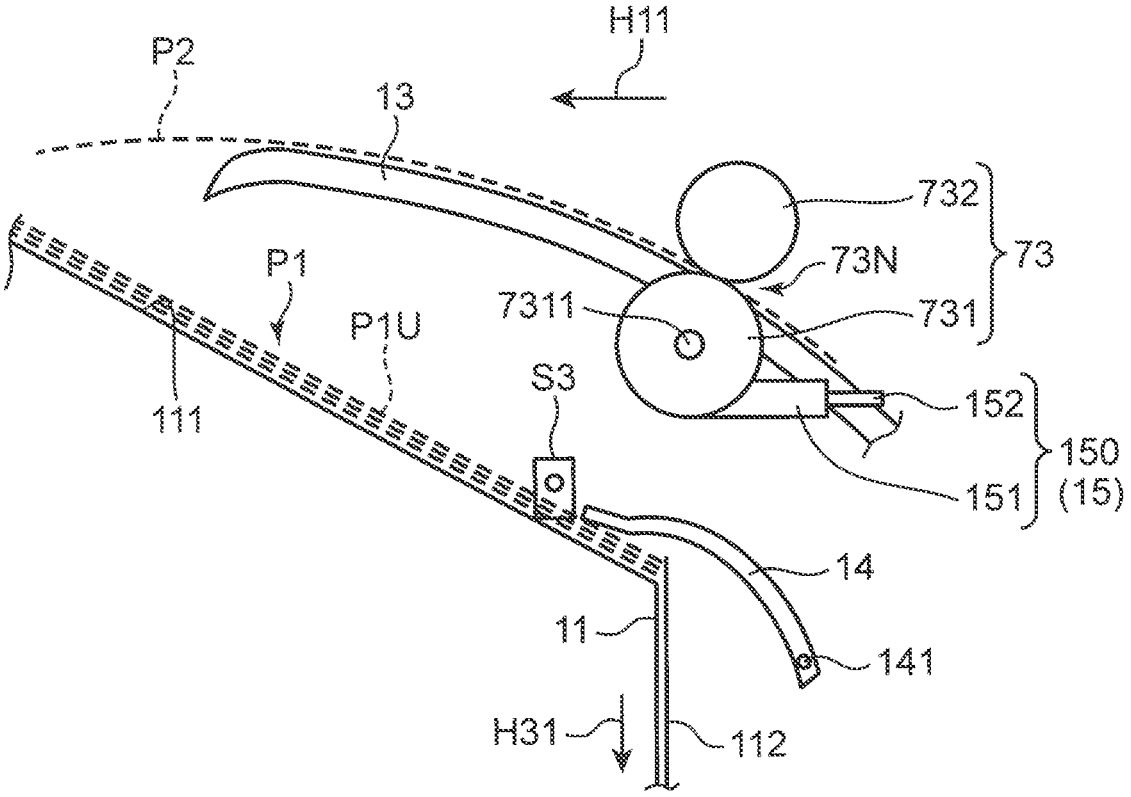
Figure 8C:
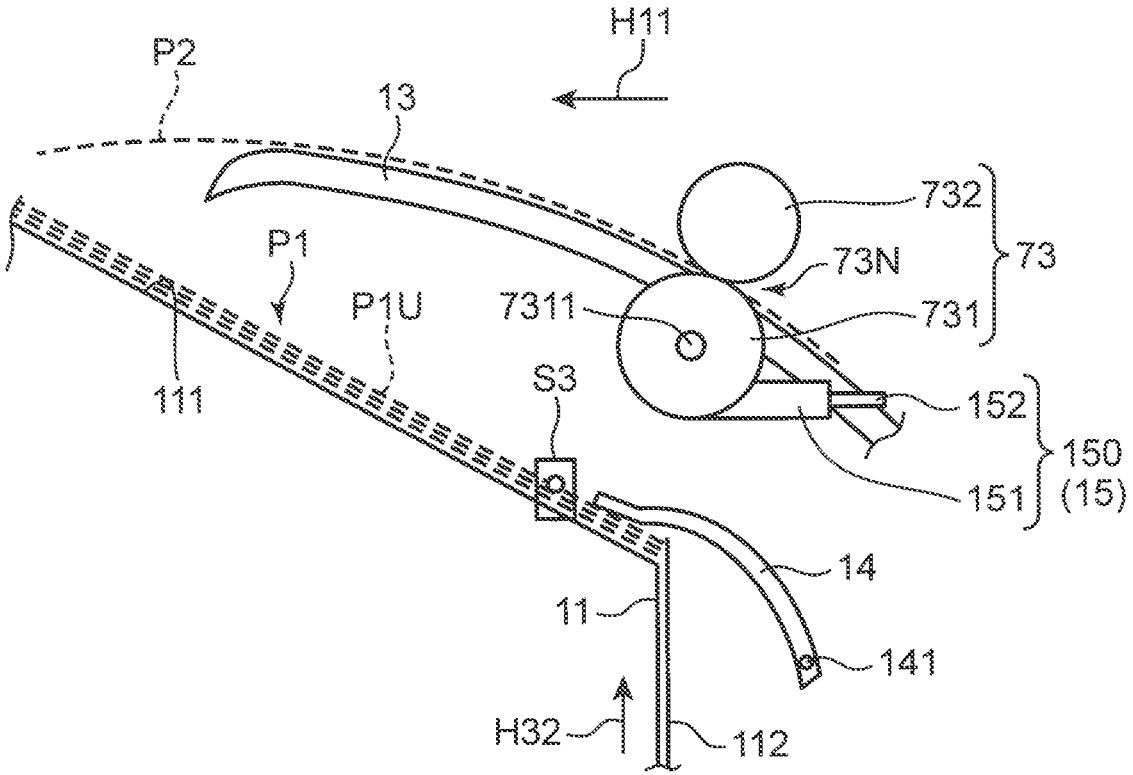

Firstly, a control of the controller 100 at the time of performing a lifting and lowering operation of the stacking tray 11 is described with reference to FIGS. 8A to 8C. FIGS. 8A to 8C are views for describing a lifting and lowering operation of the stacking tray 11 of the sheet stacking device 10. In the description made hereinafter, a sheet already stacked on the sheet stacking surface 111 of the stacking tray 11 is referred to as "sheet P1", and a sheet which is not yet stacked on the sheet stacking surface 111 and is discharged in the sheet discharge direction H11 by the pair of sheet discharge rollers 73 is referred to as "sheet P2".

As shown in FIG. 8A, the controller 100 executes sheet guide processing by controlling the advancing and retracting drive portion 131 during discharging of the sheet P2 due to the rotation of the pair of sheet discharge rollers 73 by controlling the discharge drive portion 90. In the sheet guide processing, the advancing and retracting members 13 are disposed at an advanced position where the advancing and retracting members 13 advance toward a downstream side of the pair of sheet discharge rollers 73 in the sheet discharge direction H11. During the execution of the sheet guide processing, the sheet P2 to be discharged by the pair of sheet discharge rollers 73 is brought into contact with upper surfaces of the advancing and retracting members 13 disposed at the advanced position, and is guided toward the stacking tray 11 in the sheet discharge direction H11. During the execution of the sheet guide processing, that is, during discharging of the sheet P2 by the pair of sheet discharge rollers 73, the controller 100 executes stop processing for stopping the sheet rear end beating members 15 at the stop position by controlling the rear end beating drive portion 161. The sheet rear end beating members 15 disposed at the stop position are in a state where the blades 150 are directed toward an upstream side in the sheet discharge direction H11 at the stop position. In the state where the blades 150 are directed toward the upstream side in the sheet discharge direction H11 at the stop position, the interference of the blades 150 with the discharged sheet P2 is prevented.

Then, during the execution of the sheet guide processing, the controller 100 executes tray lifting and lowering processing relating to a lifting and lowering operation of the stacking tray 11 in response to outputting of a detection signal from the upper surface detection sensor S3 by controlling the tray lifting and lowering drive portion 113. Specifically, during the execution of the sheet guide processing, when a detection signal is outputted from the upper surface detection sensor S3, the controller 100 once lowers the stacking tray 11 in a downward direction H31 by the tray lifting and lowering drive portion 113 until outputting of the detection signal is stopped (see FIG. 8B). Thereafter, the controller 100 lifts the stacking tray 11 in an upward direction H32 by the tray lifting and lowering drive portion 113 until a detection signal in response to the detection of a sheet P1U on an uppermost layer among the sheets P1 stacked on the sheet stacking surface 111 is outputted from the upper surface detection sensor S3 (see FIG. 8C).

Figure 9A:
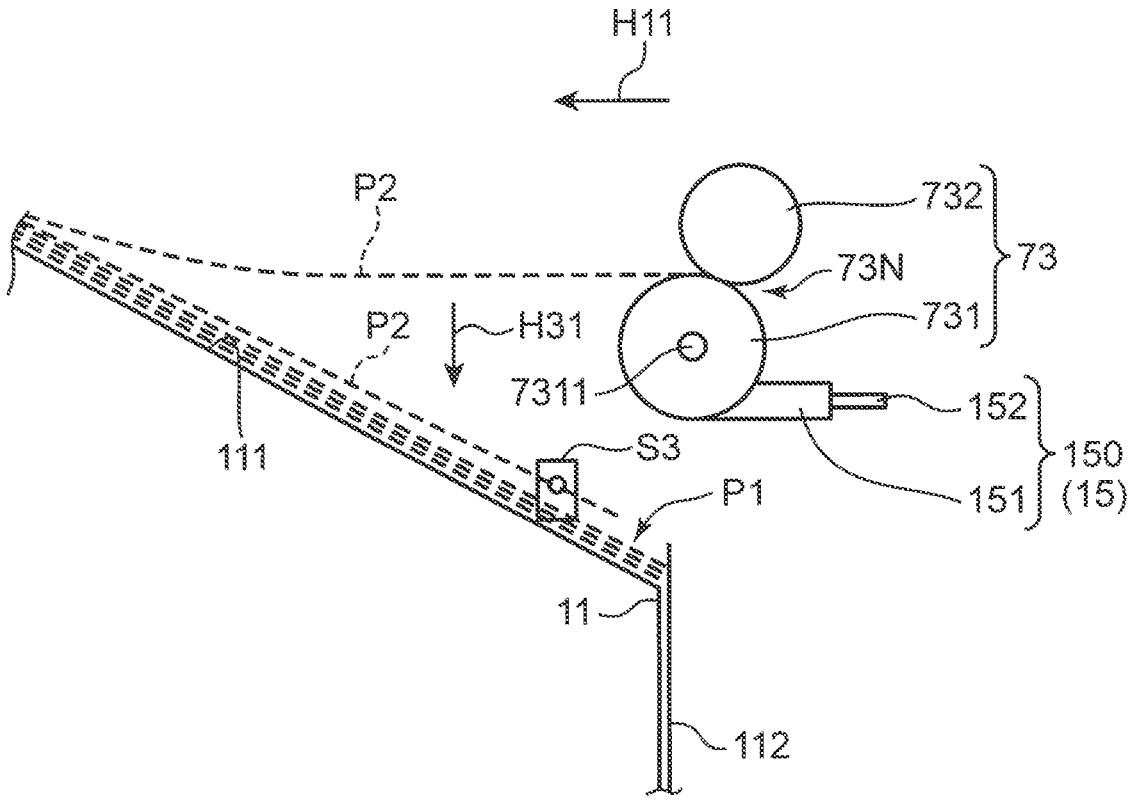
FIGS. 9A and 9B are views for describing a lifting and lowering operation of a stacking tray at timing other than the execution of sheet guide processing in prior art.
Figure 9B:
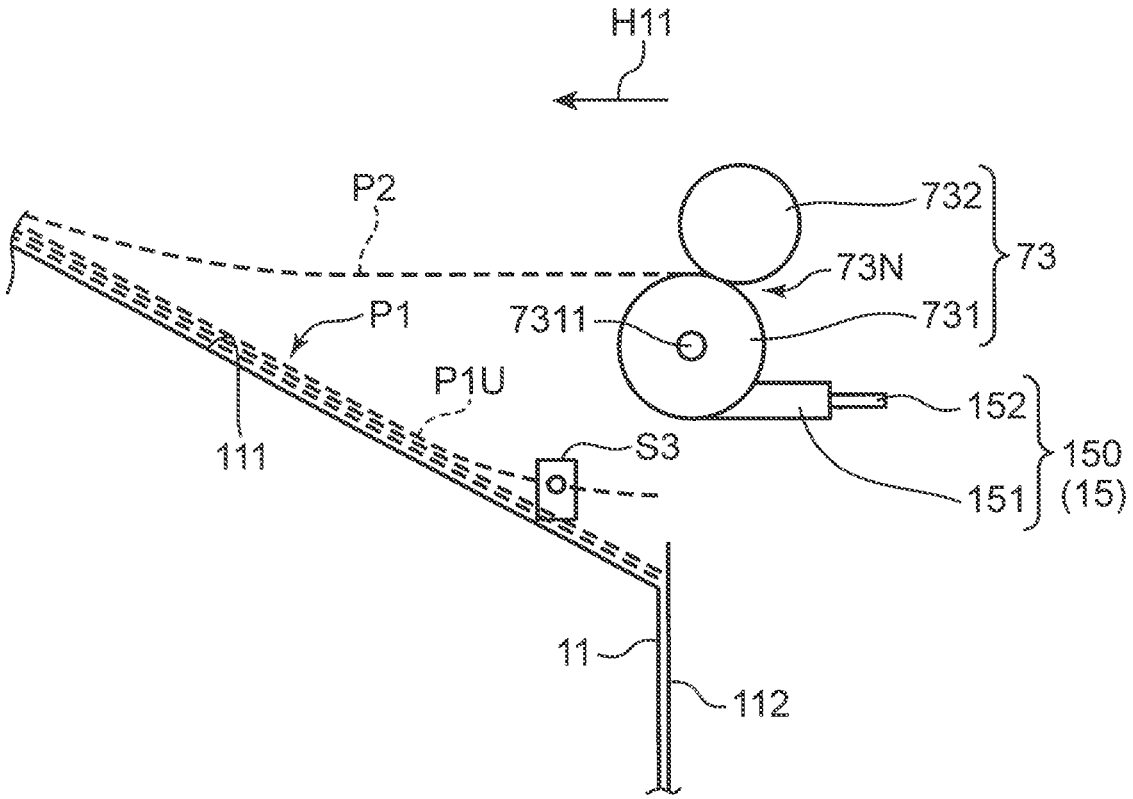

FIGS. 9A and 9B are views for describing a lifting and lowering operation of the stacking tray 11 at timing other than a period during which sheet guide processing is executed in the prior art. When a lifting and lowering operation of the stacking tray 11 is performed in response to outputting of a detection signal from the upper surface detection sensor S3 at the timing other than the period during which the sheet guide processing is executed, the following drawback occurs. As shown in FIG. 9A, assume that, during a lifting operation of the stacking tray 11 after the stacking tray 11 is lowered once, a sheet P2 which passes through between the pair of sheet discharge rollers 73 and falls toward the stacking tray 11 is detected by the upper surface detection sensor S3. In this case, the position of the sheet P2 during falling is erroneously recognized as the position of the sheet on an uppermost layer on the sheet stacking surface 111. In this case, the position of the sheet on the uppermost layer on the sheet stacking surface 111 becomes the position lower than the predetermined height position. Accordingly, a possibility is increased that a sheet discharging state becomes unstable such as the generation of curling of a distal end of the sheet P2, as shown in FIG. 9B, discharged by the pair of sheet discharge rollers 73, for example. As a result, alignment of the sheets stacked on the stacking tray 11 is deteriorated.

To the contrary, in this embodiment, as shown in FIG. 8C, during the execution of the sheet guide processing, a sheet P2 to be discharged from the pair of sheet discharge rollers 73 is guided by the advancing and retracting members 13 and hence, there is no possibility that the sheet P2 falls toward the stacking tray 11. By executing the tray lifting and lowering processing during the execution of such sheet guide processing, it is possible to prevent the detection of the sheet P2 which falls toward the stacking tray 11 by the upper surface detection sensor S3. Accordingly, it is possible to prevent the occurrence of the case where the position of the sheet P2 during falling on the stacking tray 11 is erroneously recognized as the position of the sheet P1U on an uppermost layer on the sheet stacking surface 111. As a result, it is possible to prevent the position of the sheet P1U on the uppermost layer on the sheet stacking surface 111 from becoming the position lower than the predetermined height position, and the position of the sheet P1U on the uppermost layer is maintained at the fixed height position. Accordingly, it is possible to exclude as much as possible a possibility that a discharging state of the sheet P2 becomes unstable such as excessive curling of a distal end of the sheet P2 to be discharged by the pair of sheet discharge rollers 73 and hence, the alignment of sheets stacked on the stacking tray 11 can be maintained favorably.

Further, as shown in FIG. 9B, there may be the case where an upward curl is generated on a rear end of a sheet P1 on the sheet stacking surface 111. During a lifting operation of the stacking tray 11 after the stacking tray 11 is lowered once, when the upper surface detection sensor S3 detects the curl generated on the rear end of the sheet P1, the position of the curl is erroneously recognized as the position of the sheet on an uppermost layer on the sheet stacking surface 111. Also in this case, the position of the sheet on the uppermost layer on the sheet stacking surface 111 becomes the position lower than the predetermined height position.

In view of the above, in this embodiment, as shown in FIGS. 8A to 8C, during the execution of the tray lifting and lowering processing for performing a lifting and lowering operation of the stacking tray 11, the controller 100 rotates the pressing members 14 in a counterclockwise direction about the rotary shaft 141 by controlling the rear end pressing drive portion 142. Accordingly, the pressing member 14 is disposed at the rear end pressing position where a rear end of a sheet P1 stacked on the sheet stacking surface 111 is pressed from above. By pressing the rear end of the sheet P1 stacked on the sheet stacking surface 111 from above by the pressing members 14 in this manner, even when an upward curl is generated on the sheet P1, such a curl can be pressed down. Accordingly, it is possible to prevent the detection of the curl generated on the rear end of the sheet P1 on the sheet stacking surface 111 by the upper surface detection sensor S3. As a result, it is possible to prevent the occurrence of the case where the position of the curl generated on the rear end of the sheet P1 is erroneously recognized as the position of the sheet P1U on the uppermost layer on the sheet stacking surface 111. Accordingly, it is possible to prevent the position of the sheet P1U on the uppermost layer on the sheet stacking surface 111 from becoming the position lower than the predetermined height position so that the position of the sheet P1U on the uppermost layer is maintained at the fixed height position.

Next, a control of the controller 100 when a rear end of a sheet P2 during discharging by the pair of sheet discharge rollers 73 passes though the pair of sheet discharge rollers 73 is described with reference to FIGS. 10A to 10E which are views describing such a control.

Figure 10A:
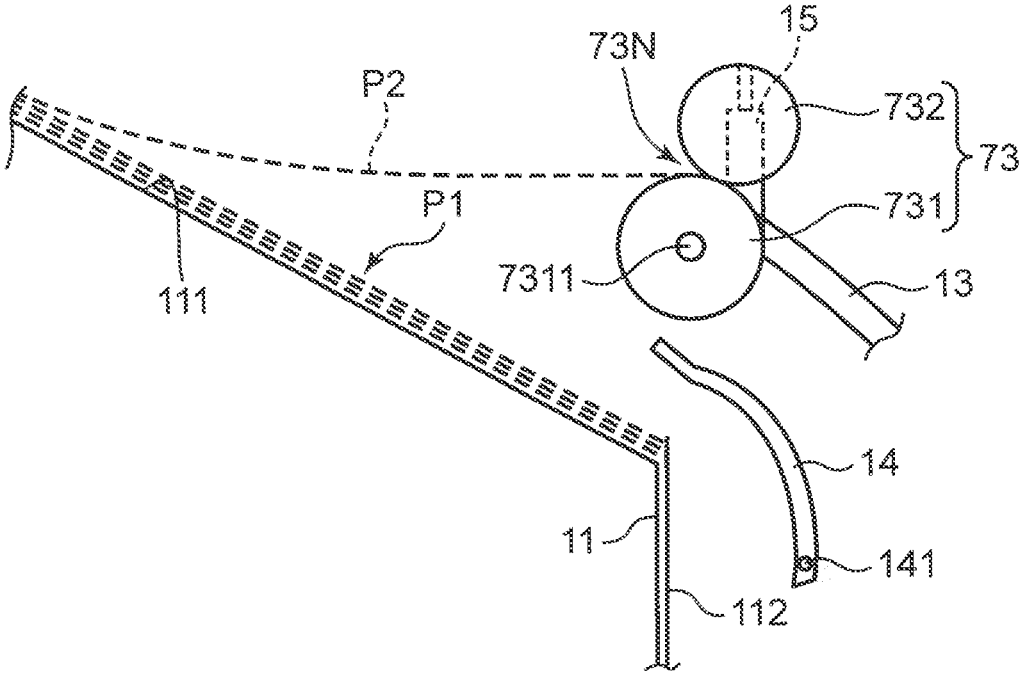
FIGS. 10A, 10B, 10C, 10D and 10E are views for describing a control operation of a controller when a rear end of a sheet passes through between a pair of second discharge rollers.

The controller 100 executes deceleration processing by controlling the discharge drive portion 90 slightly before a rear end of a sheet P2 to be discharged from the pair of sheet discharge rollers 73 passes through the pair of sheet discharge rollers 73, that is, after a lapse of a predetermined time from a point of time that a distal end of the sheet P2 is detected by the second sheet detection portion S2. In the deceleration processing, the controller 100 decelerates a rotational speed of the pair of sheet discharge rollers 73 to a rotational speed which is approximately one fifth of a highest rotational speed, for example. Then, as shown in FIG. 10A, the controller 100 executes sheet stacking allowing processing by controlling the advancing and retracting drive portion 131 before the rear end of the sheet P2 passes through the pair of sheet discharge rollers 73. The controller 100 arranges the advancing and retracting members 13 at a retracted position where the advancing and retracting members 13 are retracted on an upstream side of the pair of sheet discharge rollers 73 in the sheet discharge direction H11 by controlling the advancing and retracting drive portion 131 in the sheet stacking allowing processing. The advancing and retracting members 13 arranged at the retracted position allow stacking of the sheet P2 on the stacking tray 11 after the sheet P2 passes through the pair of sheet discharge rollers 73. Accordingly, the sheet P2 which passes through the pair of sheet discharge rollers 73 can fall on the stacking tray 11.

Further, the controller 100 rotates the pressing members 14 in a clockwise direction about the rotary shaft 141 by controlling the rear end pressing drive portion 142 before the rear end of the sheet P2 passes through the pair of sheet discharge rollers 73 and the sheet P2 is placed on the sheet stacking surface 111 of the stacking tray 11. Accordingly, the pressing members 14 are disposed at the rear end pressing release position at which rear end pressing applied to the sheet P1 stacked on the sheet stacking surface 111 is released (see FIGS. 10A to 10C). That is, the controller 100 arranges the pressing members 14 at the rear end pressing release position when the rear end of the sheet P2 passes through the pair of sheet discharge rollers 73 and the sheet P2 is placed on the sheet stacking surface 111 of the stacking tray 11. Accordingly, the sheet P2 which falls toward the stacking tray 11 after passing through the pair of sheet discharge rollers 73 is stacked on the sheet stacking surface 111 without interfering with the pressing members 14.

By increasing a conveyance speed of sheets when the sheets are continuously conveyed in the sheet post-processing device 5 to a high speed, respective execution allowable times of sheet guide processing and sheet stacking allowing processing can be shortened along with such an increase of the conveyance speed to a high speed. In such a case, when falling of a sheet P2 after passing through the pair of sheet discharge rollers 73 is maintained in a free fall state, there is a possibility that, during the execution of the sheet guide processing, the sheet P2 is in the midst of falling toward the stacking tray 11. Accordingly, even when tray lifting and lowering processing is executed during the execution of the sheet guide processing, there is a possibility that the sheet P2 in the midst of falling toward the stacking tray 11 is detected by the upper surface detection sensor S3.

Accordingly, in a state where the advancing and retracting members 13 are disposed at the retracted position, the controller 100 executes rotation processing for rotating the sheet rear end beating members 15 positioned at the stop position (see FIGS. 8A to 8C) about the rotary shafts 7311 by one turn from the stop position by controlling the rear end beating drive portion 161 (see FIGS. 10A to 10E). The above-mentioned rotation processing is executed before the rear end of the sheet P2 to be discharged due to the rotation of the pair of sheet discharge rollers 73 passes through the pair of sheet discharge rollers 73 so that the sheet P2 is placed on the sheet stacking surface 111 of the stacking tray 11.

In the above-mentioned rotation processing, a rotational speed of the sheet rear end beating members 15 is set at a speed faster than a rotational speed during a deceleration time of the second drive rollers 731 in the previously mentioned deceleration processing within a predetermined range. When the rotational speed of the sheet rear end beating members 15 is set at a speed slower than a lower limit of the above-mentioned predetermined range, there is a possibility that a beating operation and a pressing operation applied to a rear end portion of the sheet P2 by the blades 150 cannot be applied to the sheet P2 immediately after the sheet P2 passes through the pair of sheet discharge rollers 73. On the other hand, in the case where the rotational speed of the sheet rear end beating members 15 is set at a speed faster than an upper limit of the above-mentioned predetermined range, there is a possibility that, when the blade 150 is brought into contact with the rear end portion of the sheet P2, a force which pushes out the sheet P2 in the sheet discharge direction H11 is applied to the sheet P2 in addition to a force applied to the sheet P2 for making the sheet P2 fall downward.

Figure 10B:
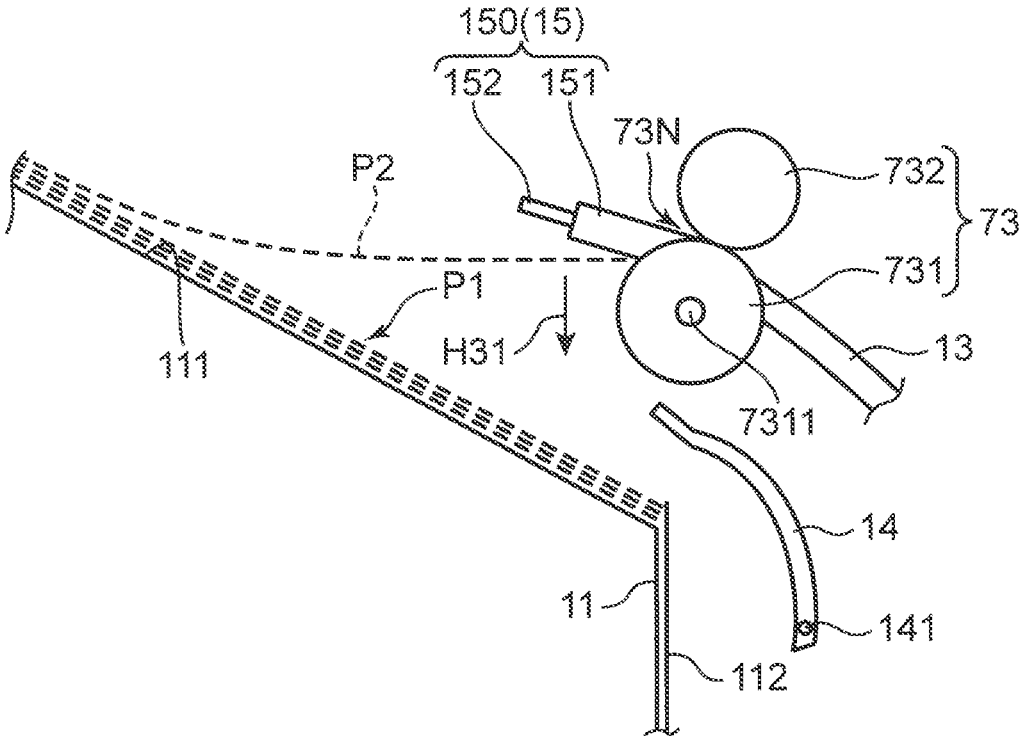
Figure 10C:
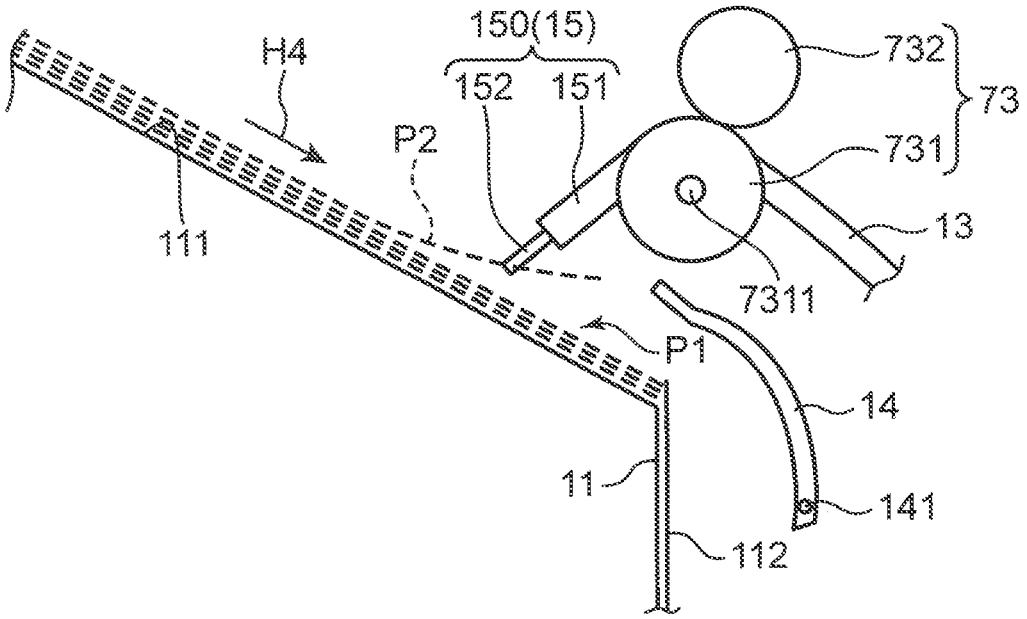

The sheet rear end beating members 15 forcibly make the sheet P2 fall on the stacking tray 11 by beating the read end portion of the sheet P2 immediately after the sheet P2 passes through the pair of sheet discharge rollers 73 in a direction toward the stacking tray 11 (downward direction H31) (see FIG. 10B). Before the blades 150 beat the rear end portion of the sheet P2 during the execution of the rotation processing, the pressing members 14 are disposed at the rear end pressing release position. The sheet P2 whose rear end portion is beaten by the sheet rear end beating members 15 speedily falls toward the stacking tray 11. Accordingly, even when a conveyance speed of the sheet is increased to a high speed, it is possible to prevent the occurrence of the case where the sheet P2 which falls toward the stacking tray 11 is detected by the upper surface detection sensor S3 due to the execution of the tray lifting and lowering processing during the execution of the sheet guide processing.

As described previously, the sheet rear end beating member 15 has only one blade 150 for beating the rear end portion of the sheet P2. Accordingly, for example, compared to the case where the sheet rear end beating member 15 is configured such that a plurality of blades are formed in a circumferential direction, a noise generated by beating a rear end portion of a sheet P2 can be reduced as much as possible.

In the rotation processing, during a period that the sheet rear end beating member 15 is rotated by one turn, the blade 150 performs a pressing operation continuously succeeding to a beating operation applied to the sheet P2 immediately after the sheet P2 passes through the pair of sheet discharge rollers 73. This pressing operation is an operation where the blade 150 presses the sheet P2 which falls on the stacking tray 11 while pulling the sheet P2 along the sheet stacking surface 111 in a direction H4 toward an upstream side in a state where the blade 150 is brought into contact with a rear end portion of the sheet P2 from above (see FIG. 10C). With such an operation, the sheet P2 which falls on the stacking tray 11 can be pulled in until the rear end of the sheet P2 is brought into contact with the sheet receiving wall 112. When a curl is generated on the rear end of the sheet P2 which falls on the stacking tray 11, the sheet rear end beating member 15 can pull the sheet P2 while pressing the curl by the blade 150.

In such an operation, the rotation of the sheet rear end beating member 15 is the rotation coaxial with the second drive roller 731 of the pair of sheet discharge rollers 73 and is the rotation independent from the rotation of the second drive roller 731. Accordingly, the beating operation and the pressing operation by the blade 150 in response to the rotation of the sheet rear end beating member 15 are applied to the sheet P2 immediately after the sheet P2 passes through the pair of sheet discharge rollers 73 without being restricted by a discharge operation of the sheet P2 by the pair of sheet discharge rollers 73. Accordingly, even when a curl is generated on the rear end of the sheet P2, the beating operation and the pressing operation can be applied to the rear end portion of the sheet P2 by the blade 150. Accordingly, the sheet P2 to be discharged toward the stacking tray 11 can be forcibly made to fall on the stacking tray 11, and floating of the sheet P2 can be prevented by pressing the rear end of the sheet P2 which falls on the stacking tray 11.

Figure 11:
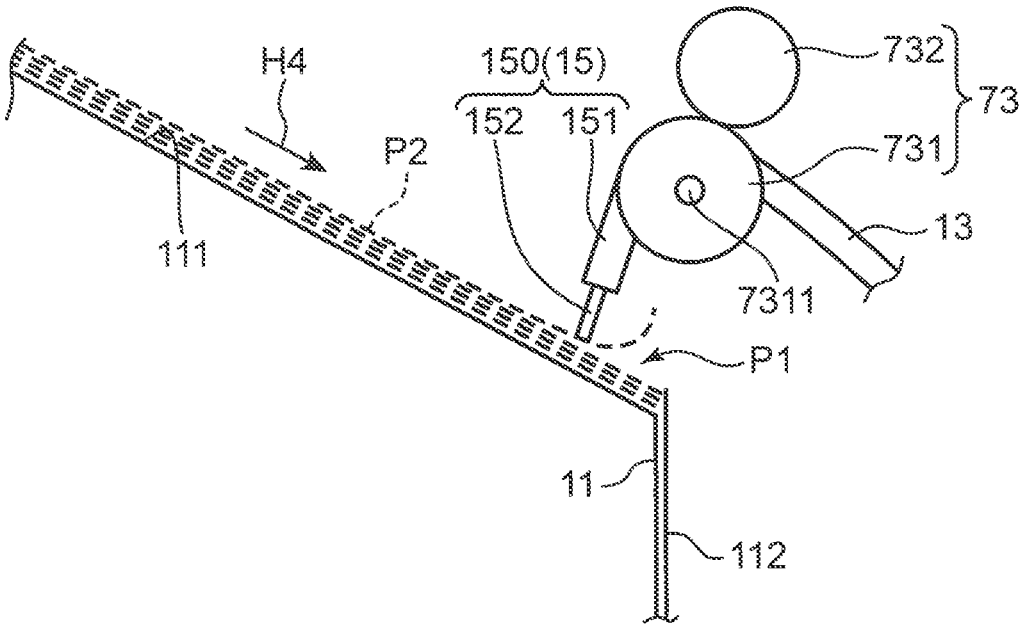
FIG. 11 is a view for describing a beating operation of a sheet rear end beating member in the prior art.

FIG. 11 is a view for describing a beating operation of the sheet rear end beating member 15 in the prior art. As shown in FIG. 11, assume the case where a relatively large upward curl is generated on a rear end of a sheet P2 which falls on the stacking tray 11. In this case, when the sheet P2 is pulled in toward an upstream side due to the rotation of the sheet rear end beating member 15, there is a possibility that the curled portion is bent by a rotational force of the sheet rear end beating member 15.

Figure 10D:
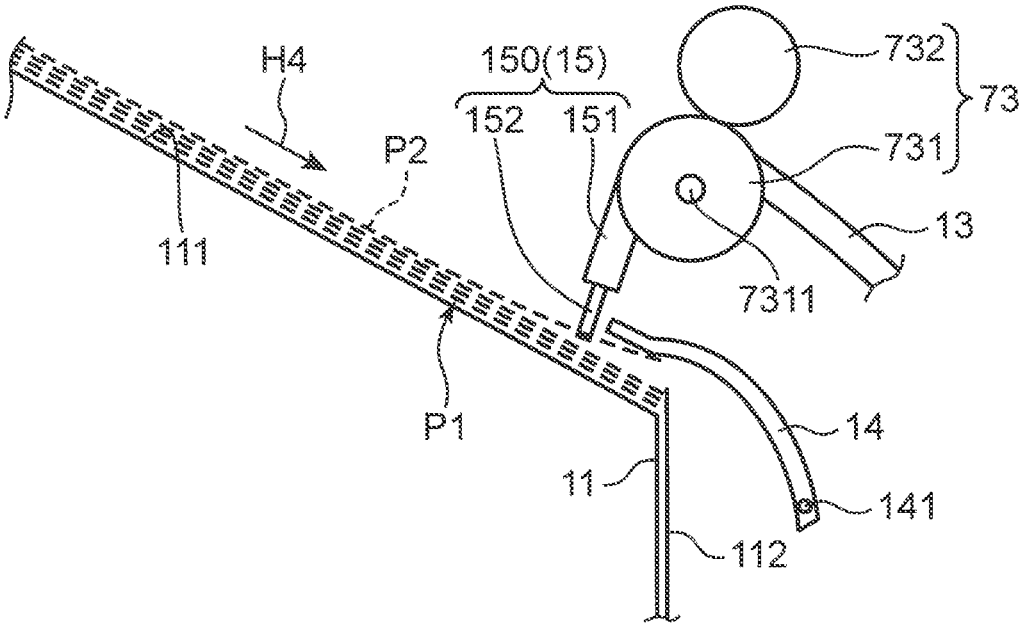
Figure 10E:
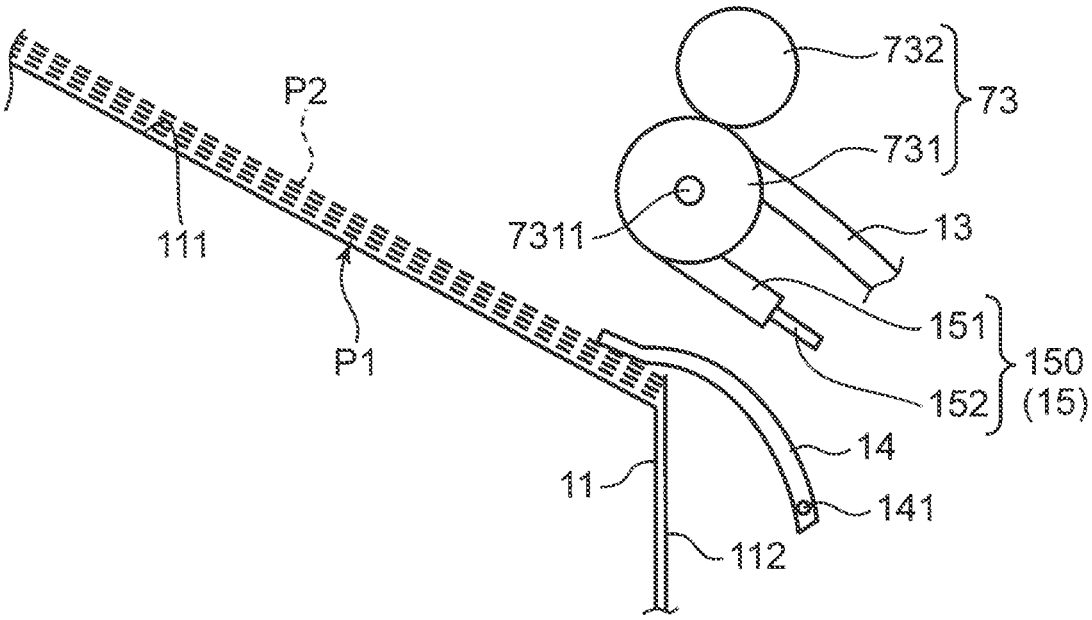

In view of the above, in this embodiment, as shown in FIGS. 10D and 10E, during the execution of the rotation processing, the controller 100 rotates the pressing member 14 in a counterclockwise direction about the rotary shaft 141 by controlling the rear end pressing drive portion 142 before the distal end of the sheet rear end beating member 15 (the distal end of the blade body part 152) during a pulling operation for pulling the sheet P2 passes an upstream end of the sheet stacking surface 111. With such a control, the pressing member 14 is disposed at the rear end pressing position where the pressing member 14 presses the rear end of the sheet P2 pulled in toward an upstream side along the sheet stacking surface 111 from above due to the rotation of the sheet rear end beating member 15. By pressing the rear end of the sheet P2 by the pressing member 14 from above in this manner, an upward curl of the sheet P2 can be pressed down. Accordingly, it is possible to prevent as much as possible the bending of the curled portion by a rotational force of the sheet rear end beating member 15.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet stacking device comprising:

a pair of sheet discharge rollers for discharging a sheet, the pair of sheet discharge rollers including a drive roller which is rotatably driven, and a driven roller which is brought into pressure contact with the drive roller and is driven to rotate along with rotation of the drive roller;

a stacking tray which is disposed downstream of the pair of sheet discharge rollers in a sheet discharge direction, and on which a sheet discharged by the pair of sheet discharge rollers is stacked;

a blade member which is disposed on a rotary shaft of the drive roller, the blade member including a body part rotatably supported on the rotary shaft and one blade protruding outward from the body part;

a first drive portion which rotatably drives the drive roller;

a second drive portion which rotatably drives the blade member in an identical direction with a rotational direction of the drive roller; and a controller which controls driving of the drive roller and the blade member by operating the first drive portion and the second drive portion; wherein the controller is configured to execute:

stop processing in which the blade member is stopped at a stop position where the blade is directed toward an upstream side in the sheet discharge direction during discharging of the sheet by the pair of sheet discharge rollers; and rotation processing in which the blade member is rotated by one turn from the stop position before a rear end of the sheet during discharging by the pair of sheet discharge rollers passes through the pair of sheet discharge rollers and the sheet is placed on the stacking tray, and the blade is configured, in the rotation processing, to make the sheet fall on the stacking tray by beating a rear end portion of the sheet which passes through the pair of sheet discharge rollers from above, and to be brought into contact with the rear end portion of the sheet which falls on the stacking tray from above to press the rear end portion of the sheet while a pulling operation for pulling the sheet toward the upstream side in the sheet discharge direction.

2. The sheet stacking device according to claim 1, wherein the blade includes:

a mounting portion which protrudes outward from the body part; and a blade body part which is mounted on and along the mounting portion so as to extend outward from the mounting portion, the blade body part having elasticity.

3. The sheet stacking device according to claim 1, wherein the controller is configured to rotate the blade member at a rotational speed faster than a rotational speed of the pair of sheet discharge rollers when a rear end of the sheet passes through the pair of sheet discharge rollers in the rotation processing.

4. The sheet stacking device according to claim 1, further comprising:

a pressing member which is swingable between a pressing position at which the pressing member presses a rear end of the sheet stacked on the stacking tray from above and a release position at which the pressing member releases the rear end of the sheet on a lower side of the blade member; wherein the controller is configured to arrange the pressing member at the release position before the blade beats a rear end portion of the sheet during execution of the rotation processing, and the controller is configured to swing the pressing member from the release position to the pressing position before a distal end of the blade in the pulling operation passes an upstream end of the stacking tray during execution of the rotation processing.

5. The sheet stacking device according to claim 1, further comprising:

a projecting member which is configured to be advanceable and retractable between an advanced position at which the projecting member protrudes toward a downstream side in the sheet discharge direction between the pair of sheet discharge rollers and a retracted position at which the projecting member is retracted on an upstream side in the sheet discharge direction; wherein the controller is configured to execute sheet guide processing where the projecting member is arranged at the advanced position and the sheet is brought into contact with an upper surface of the projecting member to guide the sheet in the sheet discharge direction during discharging of the sheet by the pair of sheet discharge rollers, and the controller is configured to arrange the projecting member at the retracted position before a rear end of the sheet being discharged by the pair of sheet discharge rollers passes through the pair of sheet discharge rollers.

6. A sheet post-processing device comprising:

a post-processing mechanism which applies predetermined post-processing to a sheet; and the sheet stacking device according to claim 1 which stacks the sheet to which the post-processing is applied by the post-processing mechanism thereon.

7. An image forming apparatus comprising:

an image forming portion which forms an image on a sheet; and the sheet post-processing device according to claim 6 which applies the post-processing to the sheet on which the image is formed.

* * * * *